US008277140B2

(12) United States Patent
Chizmar

(10) Patent No.: US 8,277,140 B2
(45) Date of Patent: Oct. 2, 2012

(54) LOOSE-LEAF BINDER

(76) Inventor: James S. Chizmar, New York, NY (US)

( * ) Notice: Subject to any disclaimer, the term of this patent is extended or adjusted under 35 U.S.C. 154(b) by 708 days.

(21) Appl. No.: 12/206,196

(22) Filed: Sep. 8, 2008

(65) Prior Publication Data

US 2009/0003925 A1 Jan. 1, 2009

Related U.S. Application Data

(63) Continuation-in-part of application No. 12/054,270, filed on Mar. 24, 2008, now abandoned, which is a continuation of application No. 10/796,634, filed on Mar. 8, 2004, now Pat. No. 7,347,640, which is a continuation-in-part of application No. 10/123,000, filed on Apr. 15, 2002, now Pat. No. 6,702,501, which is a continuation-in-part of application No. 09/698,838, filed on Oct. 27, 2000, now Pat. No. 6,371,678, which is a continuation-in-part of application No. 09/296,377, filed on Apr. 22, 1999, now Pat. No. 6,196,749.

(51) Int. Cl.

| | |
|---|---|
| ***B42F 3/02*** | (2006.01) |
| ***B42F 13/02*** | (2006.01) |
| ***B42F 3/00*** | (2006.01) |
| ***B42F 13/00*** | (2006.01) |
| ***B42F 13/04*** | (2006.01) |
| ***B42F 13/16*** | (2006.01) |
| ***B42F 13/20*** | (2006.01) |
| ***B42F 13/12*** | (2006.01) |

(52) U.S. Cl. ..... 402/20; 402/5; 402/19; 402/26; 402/29; 402/31; 402/35; 402/70; 402/73; 402/74; 402/75; 402/76; 402/77

(58) Field of Classification Search ..... 402/5, 19, 402/20, 26, 29, 31, 35, 70, 73, 74, 75, 76, 402/77, 80 R
See application file for complete search history.

(56) References Cited

U.S. PATENT DOCUMENTS 659,860 A 10/1900 Schild
(Continued)

FOREIGN PATENT DOCUMENTS

BE 494777 7/1950
(Continued)

OTHER PUBLICATIONS http://www.usringbinder.com/plastix.htm Aug. 26, 2003.
(Continued)

*Primary Examiner* — Dana Ross
*Assistant Examiner* — Justin V Lewis
(74) *Attorney, Agent, or Firm* — Locke Lord LLP

(57) ABSTRACT

A binder for releasably retaining loose-leaves. The binder has a front cover that lies flatly beneath its back cover when the binder is open 360 degrees. The rings of the binder can rotate around an edge of the flatly-folded cover to enable loose-leaves to lie flat above and below the cover. The binder also has a skeleton with a minimal cross-section spine which may be partially or completely embedded in a cover and rotates in relation to parallel front and back covers when the binder is open 360 degrees. The front cover, middle cover and back cover are connected in a way so that they do not interfere with the rotation of the rings. Mechanisms to open and close the rings of the skeleton to allow addition or removal of loose-leafs, and ring shapes to optimize or stabilize the capacity of the binder during operation are also disclosed.

23 Claims, 15 Drawing Sheets

U.S. PATENT DOCUMENTS

| | | | | | |
|---|---|---|---|---|---|
| 842,851 | A | | 2/1907 | Boden | |
| 854,074 | A | | 5/1907 | Bryant | |
| 857,377 | A | | 6/1907 | Baker | |
| 901,549 | A | | 10/1908 | Nelson | |
| 924,647 | A | | 6/1909 | Eddy | |
| 974,831 | A | | 11/1910 | Scherzinger | |
| 1,228,866 | A | | 6/1917 | Amoroso | |
| 1,398,388 | A | | 11/1921 | Murphy | |
| 1,710,493 | A | | 4/1929 | Van Valkenburgh | |
| 1,827,592 | A | | 10/1931 | Lewis | |
| 2,017,188 | A | * | 10/1935 | Tannehill | 402/35 |
| 2,051,738 | A | | 8/1936 | Ottinger | |
| 2,185,004 | A | | 12/1939 | Trussell | |
| 2,206,317 | A | | 7/1940 | Behn | |
| 2,268,431 | A | | 12/1941 | Slonneger | |
| 2,331,461 | A | | 10/1943 | Dawson | |
| 2,715,906 | A | | 8/1955 | Lucchesi | |
| 2,764,162 | A | | 9/1956 | Valla | |
| 2,924,221 | A | | 2/1960 | Dudley-Smith | |
| 3,190,293 | A | | 6/1965 | Schneider | |
| 4,130,368 | A | | 12/1978 | Jacoby | |
| 4,690,580 | A | * | 9/1987 | Kissel | 402/31 |
| 4,798,491 | A | | 1/1989 | Lässle | |
| 4,815,882 | A | | 3/1989 | Ohminato | |
| 4,848,948 | A | | 7/1989 | Pitts | |
| 4,904,103 | A | | 2/1990 | Im | |
| 4,919,557 | A | | 4/1990 | Podosek | |
| 4,930,925 | A | | 6/1990 | Baldwin | |
| 5,015,114 | A | | 5/1991 | Miller | |
| 5,104,250 | A | * | 4/1992 | Pacione | 402/73 |
| 5,213,429 | A | | 5/1993 | Johnson | |
| 5,333,962 | A | | 8/1994 | Johnson | |
| 5,553,959 | A | | 9/1996 | Feldman | |
| 5,611,633 | A | * | 3/1997 | Whaley | 402/73 |
| 5,642,954 | A | | 7/1997 | Hudspith | |
| 5,697,646 | A | | 12/1997 | Venegas | |
| 5,975,784 | A | | 11/1999 | Whaley | |
| 6,168,337 | B1 | | 1/2001 | Adams | |
| 6,196,749 | B1 | | 3/2001 | Chizmar | |
| 6,213,668 | B1 | | 4/2001 | Brown | |
| 6,371,678 | B1 | | 4/2002 | Chizmar | |
| 6,431,779 | B1 | | 8/2002 | Moor | |
| 6,702,501 | B2 | | 3/2004 | Chizmar | |
| 6,935,497 | B1 | | 8/2005 | Domotor | |

FOREIGN PATENT DOCUMENTS

| | | |
|---|---|---|
| DE | 111629 | 7/1900 |
| FR | 964994 | 8/1950 |
| GB | 2190331 | 11/1987 |

OTHER PUBLICATIONS http://www.rickieworld.com.hk/products/D-3.htm Aug. 27, 2003 (entitled "Memo Mechanism Trigger Type-6-Ring (Plastic)").
http://www.gbcoffice.com/products/binding/proclicksupplies.asp Mar. 4, 2004 (entitled "GBC ProClick™ spines").
http://www.gbcoffice.com/products/binding/zipbindsupplies.asp Mar. 4, 2004 (entitled "GBC ZipBind™ spines").
GBC office products "proClick" product literature (2 sheets).
Supplemental European Search Report of related European Application No. EP 03 72 4072, mailed Mar. 30, 2006.
Supplemental European Search Report of related European Application No. EP 00 92 6070, mailed Aug. 17, 2006.

* cited by examiner 1
61A
60D
72
60C
58C
60B
58B
46B
46
44
56
40A
50
46A
100
60A
58A
54
40
42
40B
61B
66

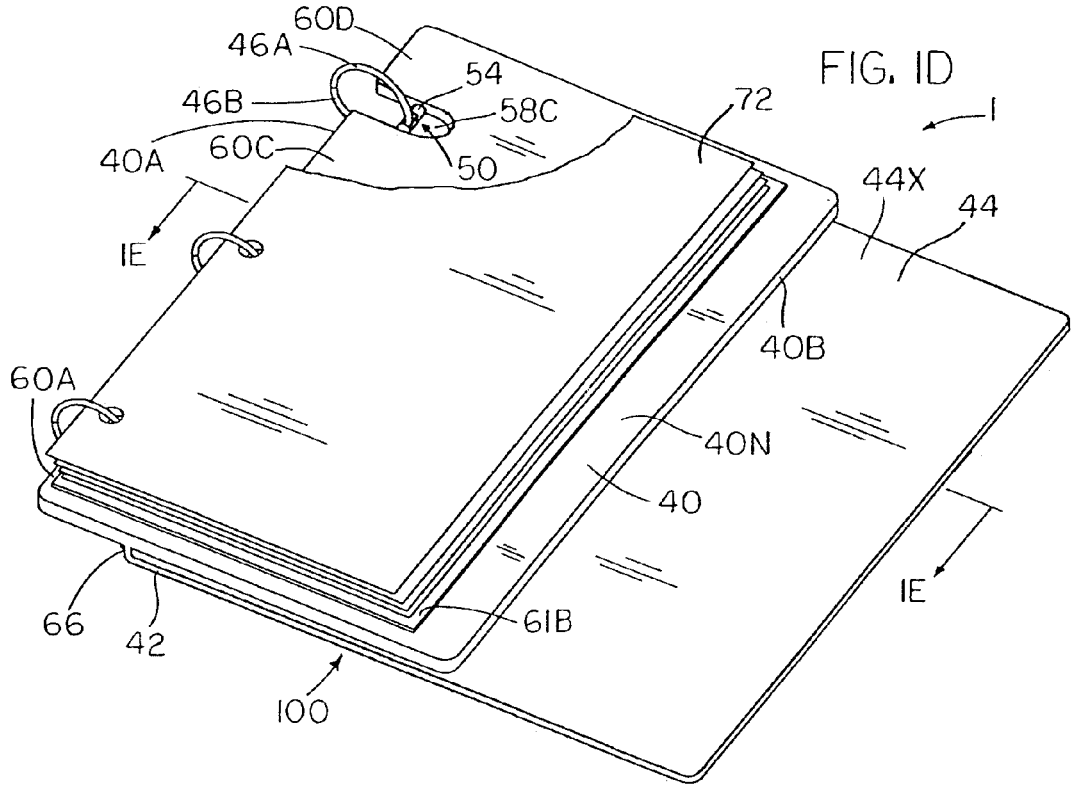
FIG. ID
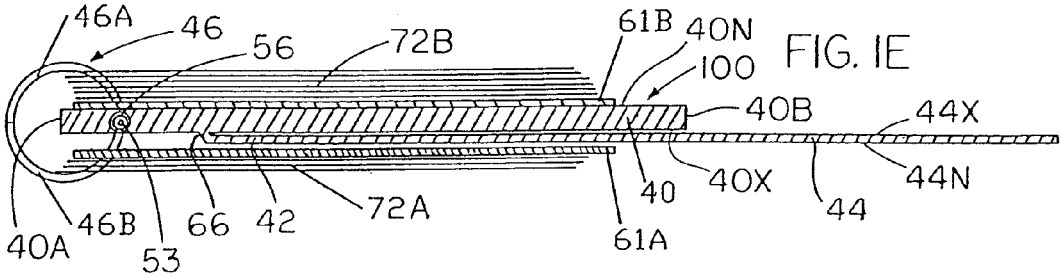
FIG. IE
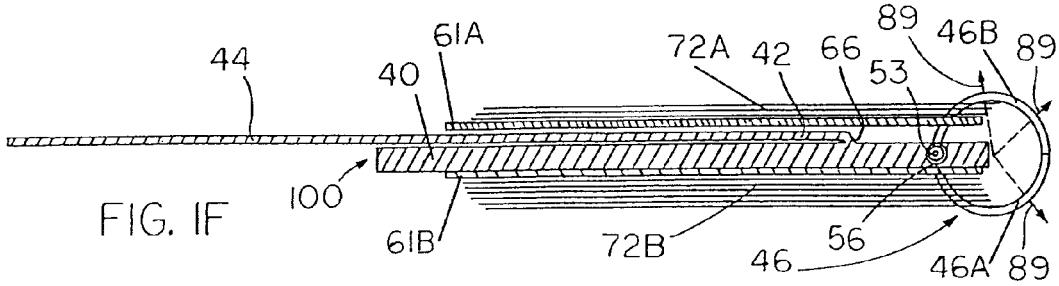
FIG. IF

FIG. 6B
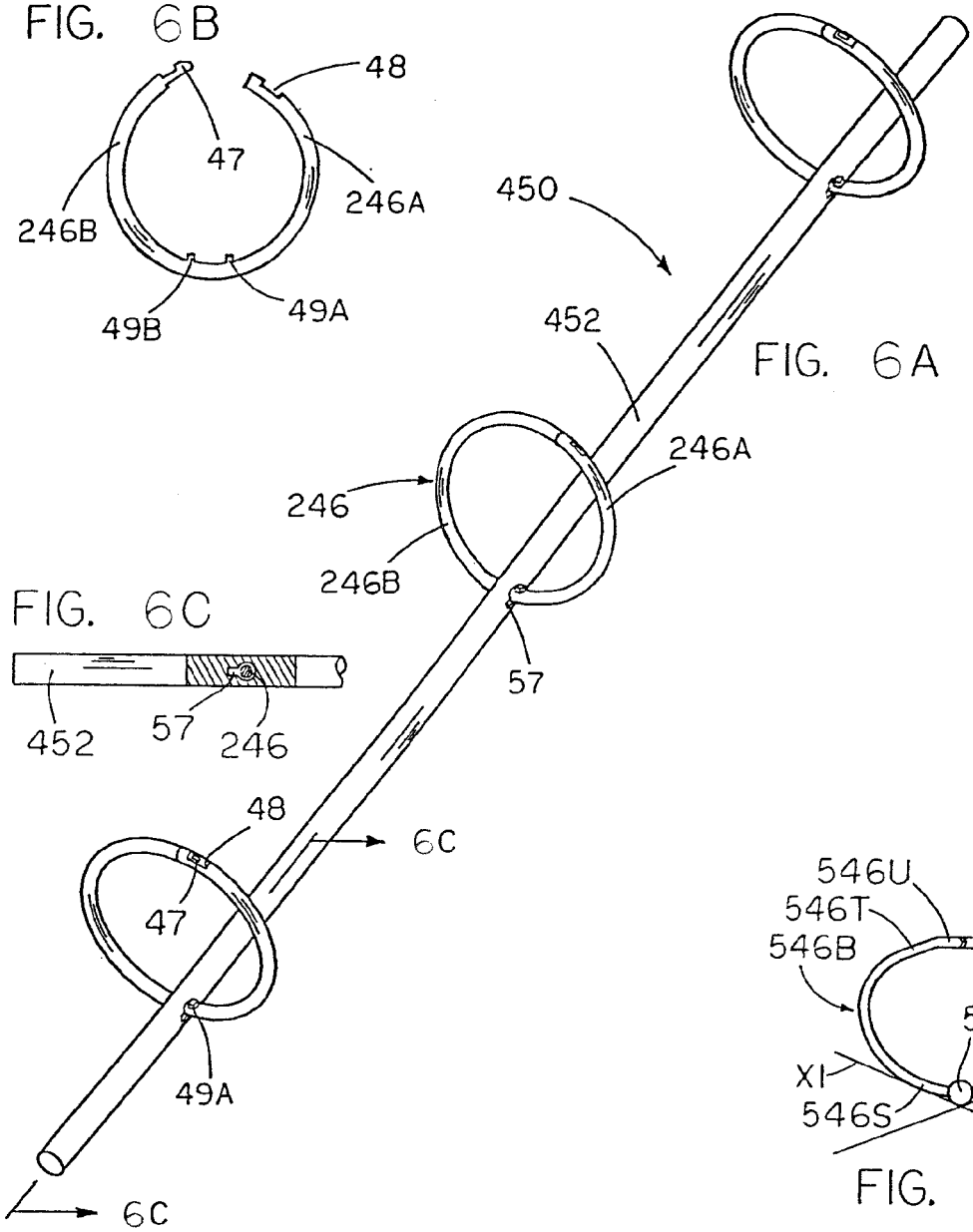
FIG. 6A
FIG. 6C
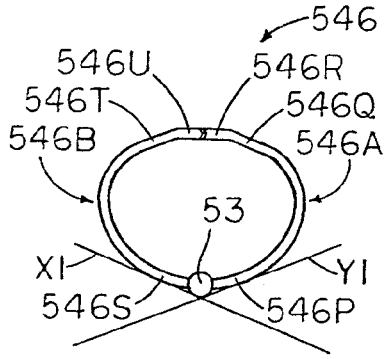
FIG. 7A
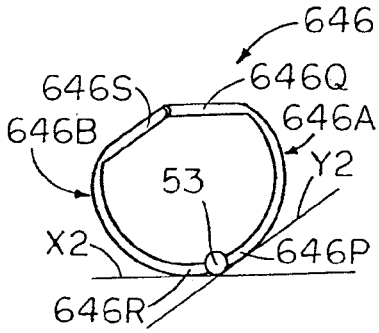
FIG. 8
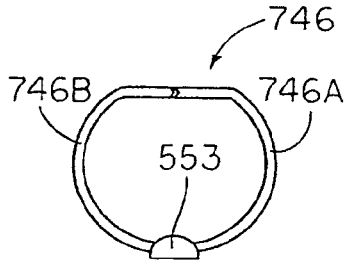
FIG. 9
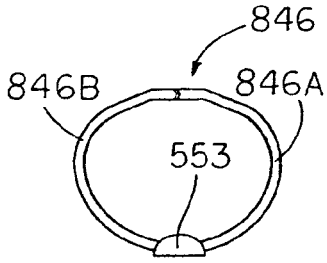
FIG. 10

FIG. 12A
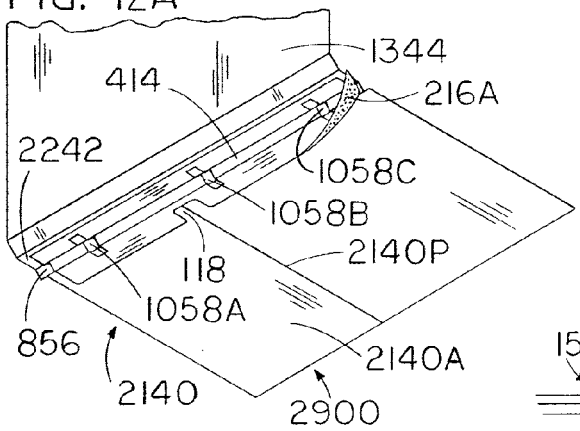
FIG. 12B
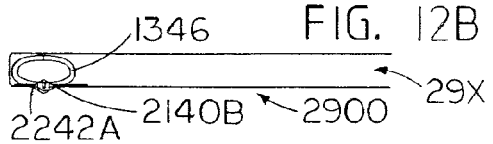
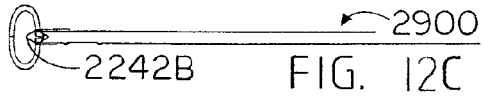
FIG. 12C
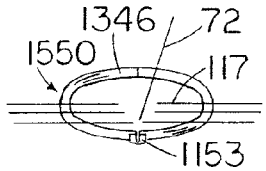
FIG. 12D
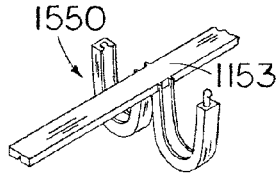
FIG. 12E
FIG. 13A
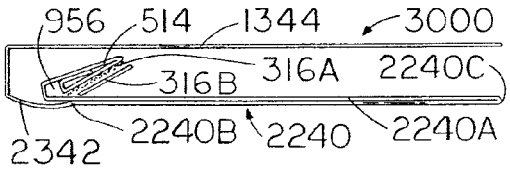
FIG. 14A
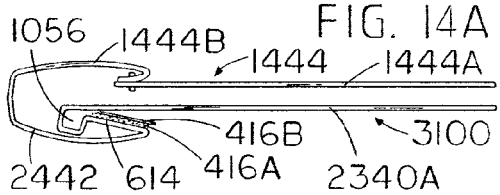
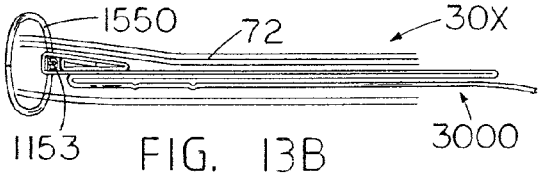
FIG. 13B
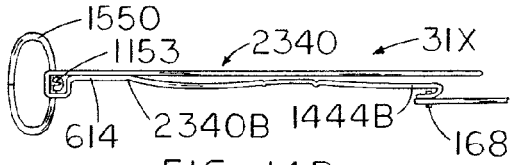
FIG. 14B
FIG. 15A
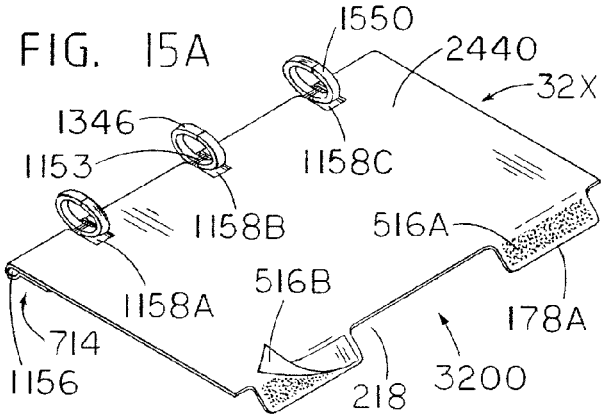
FIG. 15B
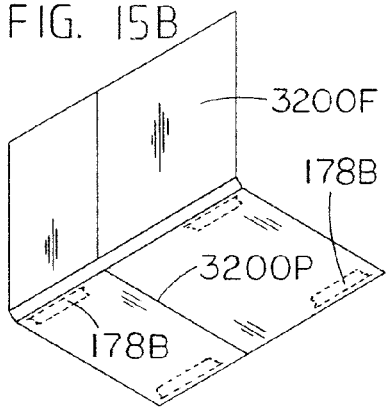

FIG. 16A
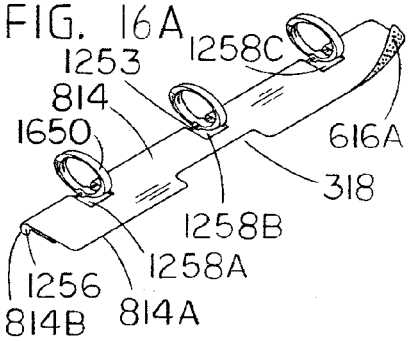
FIG. 16C
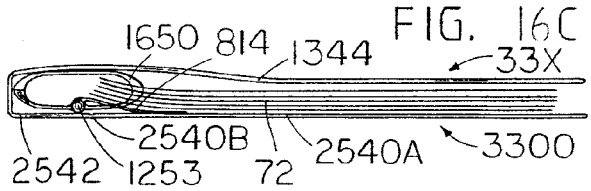
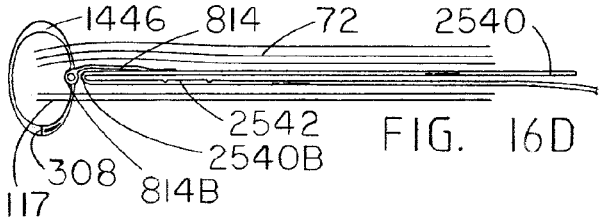
FIG. 16D
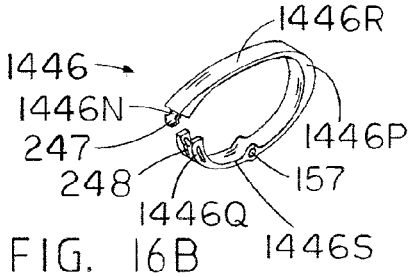
FIG. 16B
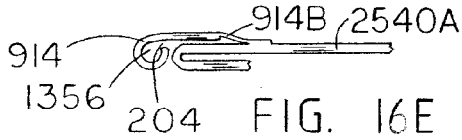
FIG. 16E
FIG. 17A
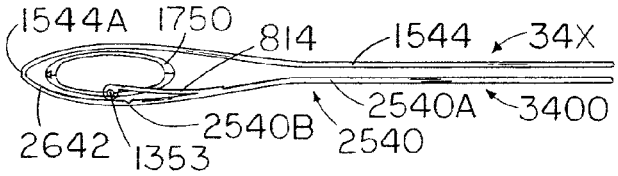
FIG. 17B
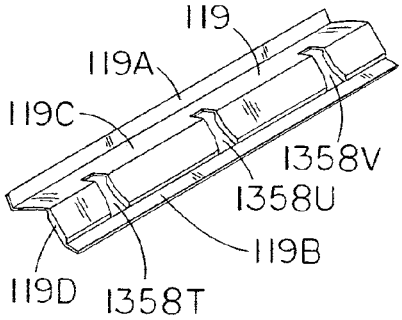
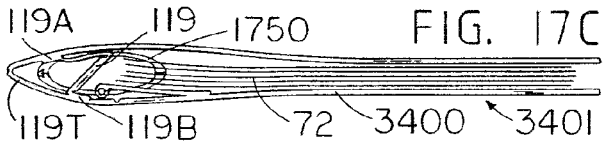
FIG. 17C
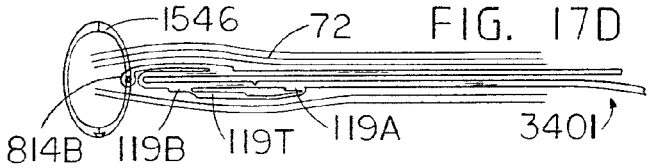
FIG. 17D
FIG. 17E
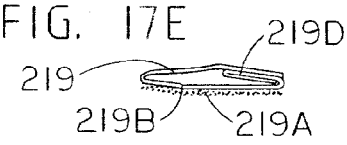
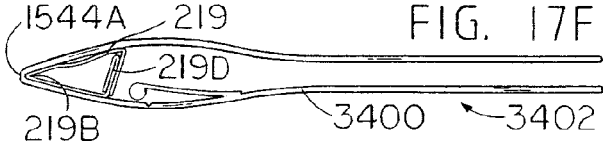
FIG. 17F FIG. 17G
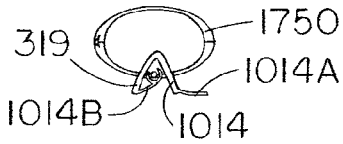
FIG. 17J
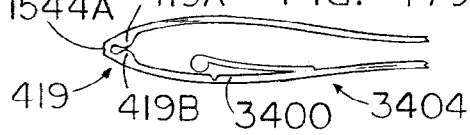
FIG. 17H
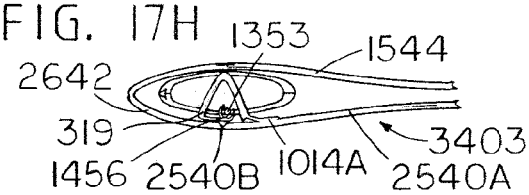
FIG. 17K
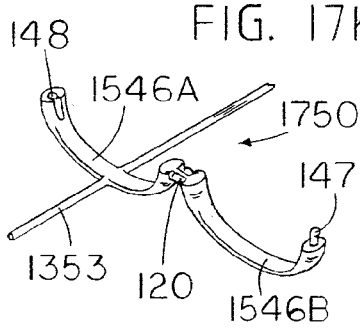
FIG. 17I
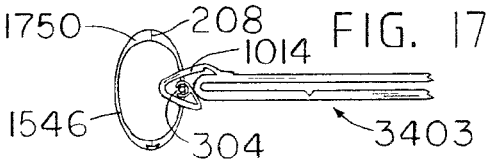
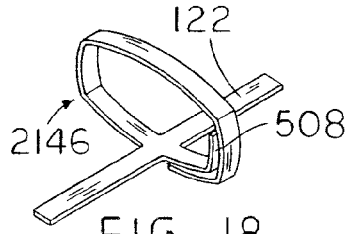
FIG. 18

LOOSE-LEAF BINDER

CROSS-REFERENCE TO RELATED APPLICATIONS

This application is a continuation-in-part of U.S. patent application Ser. No. 12/054,270 filed Mar. 24, 2008, now abandoned which is a continuation of U.S. patent application Ser. No. 10/796,634 filed on Mar. 8, 2004 now U.S. Pat. No. 7,347,640 which is a continuation-in-part of U.S. application Ser. No. 10/123,000 filed on Apr. 15, 2002, now U.S. Pat. No. 6,702,501 which is continuation-in-part of U.S. application Ser. No. 09/698,838, filed on Oct. 27, 2000, now U.S. Pat. No. 6,371,678 which is continuation-in-part of U.S. application Ser. No. 09/296,377, filed on Apr. 22, 1999, now U.S. Pat. No. 6,196,749 all of which are incorporated herein by reference in their entirety.

FIELD OF INVENTION

This invention relates to loose-leaf binders and analogous products such as loose-leaf personal organizers, loose-leaf flip charts, loose-leaf writing pads and loose-leaf photo albums.

BACKGROUND

Binders generally are comprised of two high-level assemblies, a "skeleton" and cover. The skeleton, as used herein, refers to the chassis of the binder, including the rings, spine and possible actuators, but excluding the cover. The spine, as used herein, refers to the elongated portion of the skeleton on which the rings are mounted; the spine excludes the rings, any transversely protruding elements disposed at the longitudinal ends of the skeleton such as actuation levers or proximate to the attachment points of rings such as springs wrapped around ring bases, and transversely protruding elements which are not fixed to rotate with the elongated portion such as a cover-attachment fastener wrapped about and rotatable about the elongated portion.

One object of loose-leaf binders, which is related to both the skeleton and the cover, is minimization of the "footprint" of the binder. The footprint of a binder is the area that is covered by any part of the binder when the binder is placed upon a generally flat surface. Minimizing a binder's footprint during use efficiently utilizes desk, table, or lap space.

A substitute product, the spiral notebook, specifically addresses this object by letting users flip the front cover and forward pages perfectly flat beneath the back cover and latter pages. However, spiral notebooks do not permit the easy addition or removal of pages.

Conventional loose-leaf binders have a very large footprint because, during use, the front cover is open 180 degrees relative to the back cover. This large footprint causes these binders to be cumbersome during use. Furthermore, if the front cover and forward loose-leaves are flipped behind the back cover and latter loose-leaves of a conventional binder, the forward and latter loose-leaves do not lie flat against the front and back covers, respectively. Large stress is exerted on some loose-leaves causing them to tear out of the binder and the airfoil shape of the stack of forward loose-leaves, front cover, back cover, and latter loose-leaves does not provide a flat writing surface. Furthermore in this case, writing on the topmost loose-leaf is difficult as the stack of loose-leaves bends and springs back under the shifting weight of a writing hand and wrist.

In the prior art, there have been attempts to minimize the footprints of loose-leaf binders during use while eliminating the problems mentioned above for conventional binders. However, each of these attempts has had some failing including: (1) sacrifice of a desired feature, (2) only partial achievement of this functionality, and (3) addition of undesirable characteristics.

The failings of known loose-leaf binders to minimize binder footprints are principally the result of (1) the large transverse cross-section dimensions of spines of known skeletons, (2) the methods employed to attach covers to skeletons, and (3) the design of the covers.

The first main cause of these failings, the large transverse cross-section dimensions of loose-leaf binder skeleton spines, has generally resulted from a common objective of skeletons, the ability to simultaneously open and close all rings of a skeleton via a simple actuation mechanism. SOCRA, which is used herein to describe these skeletons, is an acronym for Simultaneously Openable/Closeable Rings Actuation.

Conventional loose-leaf binders have SOCRA skeletons with spines having transverse cross-sections with major and minor dimensions wherein the large major dimension is built into the perimeter of the rings whereas the minor dimension is substantially radial to the center of the rings. Binder skeleton spines have traditionally had a transverse cross-section with a ratio of major to minor dimensions greater than two.

Conventional loose-leaf binders have a front cover attached to a middle cover which in turn is attached to a back cover. The SOCRA skeleton is rigidly fixed to the middle cover or back cover via rivets.

Exemplary dimensions of conventional loose-leaf binder covers in the market are as follows:

| Front and Back Cover Thickness | Middle cover Thickness |
|---|---|
| 2 mm | 2 mm |
| 3 mm | 4.5 mm |
| 4 mm | 5 mm |

Typical dimensions of conventional loose-leaf binder skeletons in the market are as follows:

| Ring Outer Diameter | Ring Prong Thickness | Skeleton Spine Width |
|---|---|---|
| 13.5 mm | 1 mm | 10 mm |
| 21 mm | 2 mm | 16 mm |
| 32 mm | 2.8 mm | 25 mm |
| 75 mm | 3.5 mm | 50 mm |

A ring outer diameter differs from its corresponding ring inner diameter by two ring prong thicknesses. Skeleton spine width is the major transverse cross-section dimension of a binder skeleton spine. The widths of skeleton spines are affected and constrained by the SOCRA mechanism employed and ring prong thickness. Note that as ring size increases, prong thickness increases to handle the stronger forces acting on the rings. Because ring prongs are commonly riveted into plates in conventional skeletons, as ring prongs increase in thickness, the skeleton spine width also must increase to secure the thicker prongs. The smallest conventional binders in the market which are small pocket binders have skeleton spine widths that are still 10 mm thick. Because of the thinness of cover segments and thickness of SOCRA skeleton spines in the prior art, the prior art generally teaches away from embedding of a SOCRA skeleton spine in a binder cover.

The large transverse cross-section of known SOCRA skeleton designs has led to the orientation of the transverse cross-section such that the major dimension is substantially radial to the center of the rings in an attempt to minimize the binder footprint. However, this orientation has made attachment to the cover more difficult which in turn has led to the use of loose-leaf front and back covers with no middle cover disposed therebetween. Such configuration exposes the rings and the ends of the loose-leaves leaving both less protected and makes the binder cumbersome to handle and less attractive. In such a known binder, the skeleton creates an awkward lump, thwarting the object of a flat writing surface, when positioned within a stack of loose-leaves or when positioned between the front cover and back cover after the front cover is flipped around against the back cover. U.S. Pat. Nos. 3,190,293 to Schneider, 4,904,103 to Im and 2,331,461 to Dawson are examples of such known binders.

Alternatively, to minimize binder footprints, some loose-leaf binders have independently-openable rings. In some of these loose-leaf binders, the back cover pivots about the thin skeleton spine and the front cover hangs loose-leaf on the rings, but there is no middle cover joining the front cover to the back cover. These designs make insertion and removal of loose-leaves tedious. Also, the exposed rings are unattractive and the loose-leaves are less protected. U.S. Pat. Nos. 659,860 to Schild and 2,268,431 to Slonneger are examples of such binders.

Yet another problem with known attempts to build a minimal-footprint binder are inadequate ring shapes having varying loose-leaf capacity when these binders are open 360 degrees versus when they are closed. This variation in capacity results from inclusion of the skeleton among the loose-leaves in one position but not in the other. U.S. Pat. No. 4,904,103 to Im is an example of such a binder.

SUMMARY OF INVENTION

Accordingly, this invention provides an improved binder that satisfies the object of providing a binder with a minimal footprint during operation while obviating the disadvantages of the prior art. The invention includes improvements to the binder skeleton, cover and attachment of the skeleton to the cover.

To minimize the binder footprint, the various embodiments of the invention described below contain at least one of the following elements as features:

(1) Skeleton with a minimal LSCPL (defined below).
(2) SOCRA skeleton.
(3) Cover designs that allow the front cover and back cover to fold in flat formations when open 360 degrees while simultaneously allowing the rings to rotate around an edge of the flatly-folded cover.
(4) Spine of skeleton axially disposed relative to rotation of rings and oppositely rotating back cover when the binder is open 360 degrees.
(5) Spine of skeleton embedded or partially embedded in cover in design and/or during operation of binder.
(6) Middle cover joining front cover to back cover.
(7) Attachment of the middle cover to back cover so that the covers do not interfere with rotation of the rings when the binder is opened 360 degrees.
(8) Slots or holes to eliminate interference of cover with skeleton rings as skeleton rings rotate through plane of back cover.
(9) Longest ring dimension is much larger than the LSCPL (defined below).
(10) Attachment of skeleton to cover in a way that allows the front cover to lie flat on the back cover while the binder is open 360 degrees.
(11) Rings hidden (not exposed) when binder is closed.
(12) Writing-support pads (described below).
(13) Stable, incremental rotation of rings about an edge of the flatly-folded cover without a strong bias to particular positions.
(14) Ring shapes with particular orientations to skeleton and cover to optimize or stabilize binder capacity.

The preferred embodiments have a spine. LSCPL is an acronym for the Longest Spine Cross-section Perimeter Line segment and refers to the longest line segment connecting two points on the perimeter of the transverse cross-section of the skeleton spine. For example, for a skeleton spine having a circular cross-section, the LSCPL is the circle's diameter; for an ellipse, the LSCPL is the major axis; for a square or rectangle, the LSCPL is a diagonal; for a triangle, the LSCPL is the longest side of the triangle.

The LSCPL dimension is important. When the binder cover is open 360 degrees, the binder cover is turned inside out such that at least a portion of the interior surfaces of the front and back covers face in opposite directions and the skeleton spine as well as a portion of the cover may be sandwiched between forward and latter loose-leaves. Preferably, the cover folds flat when open 360 degrees. The rings must be able to rotate while the cover is open 360 degrees. In the preferred embodiments, rotation of the rings necessitates that the spine rotate. If the LSCPL dimension is less than or equal to the thickness of the front and back covers, the spine can lie completely between the interior surface planes of the front and back cover throughout the complete range of the spine's rotation; in this case, the spine can remain flush with the front and back cover so that any potential lump caused by the spine while it is sandwiched between forward and latter loose-leaves is minimized or prevented so as to present a flatter top loose-leaf surface. Furthermore, the LSCPL dimension influences the desired thickness of a cover segment having a conduit in which the spine is rotatably disposed as a pivot of cover rotation; as the cover segment rotates about the spine, the conduit containing the spine must accommodate the LSCPL dimension.

Various features of each preferred embodiment cooperate to enable its loose-leaves above and below the back cover to lie flat and parallel when the cover is open 360 degrees whether none, one, many, or all of the loose-leaves are flipped below the back cover.

In the preferred embodiments, a SOCRA skeleton is rotatably disposed in a cover such that (1) the spine is a pivot about which the cover can rotate and (2) the spine is axially disposed relative to opposite rotations of the cover and rings.

Several embodiments of skeletons for use with the binder are disclosed for minimizing the LSCPL. For example, in one embodiment of a skeleton, the rings are attached via a space-saving weld or braze versus the space-demanding riveting of conventional binders.

Embedment of a skeleton in a cover segment without the segment becoming awkwardly thick and unattractive becomes feasible beginning with skeletons having LSCPL values of about 7-9 mm. Most preferably, the LSCPL of the skeleton is less than or equal 5 mm.

Preferably, the binder has a SOCRA skeleton with a synchronized switching element to open or close its rings simultaneously. The preferred synchronized switching element has a first connective element which connects to one set of ring segments and a second connective element which connects to a corresponding and opposing second set of ring segments. The synchronized switching element has a mechanism to enable the first connective element to move in relation to the second connective element so as to open or close the first ring segments relative to the second ring segments.

Means for attaching the front, middle and back cover segments are also disclosed.

Objects and Advantages

Accordingly, several objects or advantages of my invention contained in various embodiments described below are:

(a) to provide a binder which can minimize its footprint during use by flipping the front cover and any number of forward loose-leaves flatly beneath the back cover and latter loose-leaves and which lacks the limitations and failings of past attempts cited;

(b) to provide a binder which is reversible, so that either side may be used with equal advantages, the reversal being accomplished by opening the binder 360 degrees and then positioning it to access either the back of the exposed forward loose-leaf page or front of the exposed latter page, whereby either or both sides of a page may be written upon;

(c) to provide a binder which always presents a flat writing surface including when the front cover is opened 180 or 360 degrees relative to the back cover, and the whole surface of the current loose-leaf page is flat and can be used from edge to edge and top to bottom;

(d) to provide a binder whose front and back covers and optional writing-support pads may take the place of a desk, offering good support to write upon if the pad is rested in a lap or held in the hand;

(e) to provide an attractive binder with rings hidden when closed;

(f) to provide a binder affording superior protection to loose-leaves via a surrounding cover;

(g) to provide a binder that is easy to handle, conveniently packs in brief cases and book bags and stacks or stands well on a bookshelf;

(h) to provide a binder which reduces tearing stress on its loose-leaf pages when they are flipped beneath the back cover and latter pages;

(i) to provide a thin binder when closed by embedding the skeleton spine in the cover;

(j) To provide a binder with releasably retaining rings to bind loose-leaf pages permitting easy addition or removal of loose-leaf pages as desired;

(k) to provide a binder with the ability to simultaneously open or close all of the binder's rings by a skeleton mechanism to reduce the effort of adding or removing loose-leaf pages;

(l) to provide a binder with the smallest possible LSCPL skeleton value to eliminate or minimize any lump cause by the skeleton when the binder is open 360 degrees but where the skeleton fulfills its requirement to enable simultaneous opening and closing of all rings;

(m) to provide a binder with a skeleton which can accommodate various numbers and spacings of rings;

(n) to provide a binder with a skeleton that is spring urged to or can be locked in either of two stable states, an open position or closed position so its rings do not inadvertently open or close;

(o) to provide a skeleton with a ring shape that provides substantially constant capacity during operation when the skeleton may be rotated from its upright position; and (p) to provide a binder that can be manufactured cheaply.

Further objects and advantages of my invention will become apparent from consideration of the drawings and ensuing description.

BRIEF DESCRIPTION OF DRAWINGS

The accompanying drawings, which are incorporated in and form a part of this specification, illustrate embodiments of the invention by way of example and not by way of limitation. The drawings referred to in this specification should be understood as not being drawn to scale except if specifically noted.

FIG. 1D is a perspective view of the binder of FIG. 1A with the front cover and forward loose-leaf pages flipped approximately 360 degrees to a fully open position flatly beneath the back cover and latter loose-leaf pages.

FIG. 1E is a cross-sectional view of the binder of FIG. 1D along line 1E-1E in FIG. 1D.

FIG. 1F is a sectional view of the binder of FIG. 1E after it has been flipped over 180 degrees to enable writing on the back side of a forward loose-leaf page.

FIG. 6A is a perspective view of another embodiment of a skeleton for use with the binder that has its rings closed.

FIG. 6B is a bottom view of a ring component of the skeleton of 6A.

FIG. 6C is a partial, cross-sectional view of FIG. 6A indicated by the section lines 6C-6C in FIG. 6A.

FIG. 7A is a bottom view of another embodiment of a ring for use with the binder that has a partially elliptical shape with three linear top segments.

FIGS. 7B-7F depict skeleton rotation and related cover positions as the front cover, writing-support pad, and varying numbers of forward loose-leaves are flipped beneath the back cover and varying number of latter loose-leaves.

FIG. 8 is a bottom view of another embodiment of a ring for use with the binder that has a partially elliptical shape with two linear top segments.

FIG. 9 is the bottom view of another preferred embodiment of a ring component.

FIG. 10 is the bottom view of another preferred embodiment of a ring component.

FIG. 12A is a perspective view of another preferred embodiment of a cover for use with the binder with an extra thin closed-cover thickness.

FIG. 12B is a bottom view of another preferred embodiment of the binder employing the cover of FIG. 12A and skeleton of FIGS. 12D-12E and positioned with its cover closed.

FIG. 12C is a bottom view of the binder of FIG. 12B positioned with its front cover flatly opened 360 degrees relative to its back cover.

FIG. 12D is a bottom view of another preferred embodiment of a skeleton for use with the binder with oblong elliptical rings.

FIG. 12E is a perspective view of a portion of the skeleton of FIG. 12D as initially molded as a single piece of plastic.

FIG. 13A is a bottom view of another preferred embodiment of a cover for use with the binder with an extra thin closed-cover thickness and with a conduit casing having an instant user-sealed wrap-flap closure facilitating skeleton selection by user.

FIG. 13B is a bottom view of another preferred embodiment of the binder incorporating the cover of FIG. 13A and skeleton of FIG. 12E and is positioned with its front cover flatly opened 360 degrees relative to its back cover with ring-bound loose-leaves added.

FIG. 14A is a bottom view of another preferred embodiment of a cover for use with the binder with an extra thin closed-cover thickness and with a conduit casing having an instant user-sealed wrap-flap closure.

FIG. 14B is a bottom view of another preferred embodiment of the binder incorporating the cover of FIG. 14A and skeleton of FIG. 12E and is positioned with its front cover flatly opened 360 degrees relative to its back cover.

FIG. 15A is a perspective view of another preferred embodiment of the binder incorporating the skeleton of FIG. 12E and having instant user-affixed attachment strips for permanent placement upon folder surfaces.

FIG. 15B is a perspective view of a typical folder to which the binder of FIG. 15A can be attached and indicates preferred attachment locations.

FIG. 16A is a perspective view of a preferred embodiment of a subassembly comprising a conduit casing joined to another preferred embodiment of a skeleton for use with the binder.

FIG. 16B is a perspective view of another preferred embodiment of a ring for use with the binder and which is reversibly compressible.

FIG. 16C is a bottom view of another preferred embodiment of the binder, which is situated under vertical compression with ring-bound loose-leaves and which has an ultra thin closed-cover thickness made possible by reversibly compressible rings of FIG. 16B.

FIG. 16D is a bottom view of the binder of FIG. 16C positioned with its front cover opened 360 degrees relative to its back cover in a flat formation with its ring-bound loose-leaves.

FIG. 16E is a bottom view of another preferred embodiment of a conduit casing for use with the binder.

FIG. 17A is a bottom view of another preferred embodiment of the binder featuring an ultra thin aesthetically-pleasing streamline closed cover contour via compressible rings of FIG. 17K synergistically combined with a cover having a primary cover fold.

FIG. 17B is a perspective view of a preferred embodiment of a ring-crush resister for use with the binder.

FIG. 17C is a bottom view of another preferred embodiment of the binder situated under vertical compression with ring-bound loose-leaves and featuring an ultra thin closed-cover thickness and the ring-crush resister of FIG. 17B.

FIG. 17D is a bottom view of the binder of FIG. 17C positioned with its front cover open 360 degrees relative to its back cover in a flat formation with its ring-bound loose-leaves.

FIG. 17E is a bottom view of another preferred embodiment of a ring-crush resister for use with the binder.

FIG. 17F is a bottom view of another preferred embodiment of a cover for use with the binder featuring an ultra thin closed-cover thickness and the ring-crush resister of FIG. 17E.

FIG. 17G is a bottom view of another preferred embodiment of a subassembly comprising a integral combination conduit casing ring-crush resister joined to the skeleton of FIG. 17K for use with the binder.

FIG. 17H is a bottom view of another preferred embodiment of the binder situated under vertical compression with an ultra thin closed-cover thickness and incorporating the subassembly of FIG. 17G.

FIG. 17I is a bottom view of the binder of FIG. 17H positioned with its front cover opened 360 degrees relative to its back cover in a flat formation.

FIG. 17J is a bottom view of another preferred embodiment of a cover for use with the binder with an ultra thin closed-cover thickness and featuring another preferred embodiment of a ring-crush resister.

FIG. 17K is a perspective view of another preferred embodiment of a skeleton for use with the binder featuring reversibly compressible rings with flip-top hinges as initially molded as a single piece of plastic.

FIG. 18 is a perspective view of another preferred embodiment of an oblong ring for use with the binder featuring a spiral closure.

DETAILED DESCRIPTION

Figure 1A:
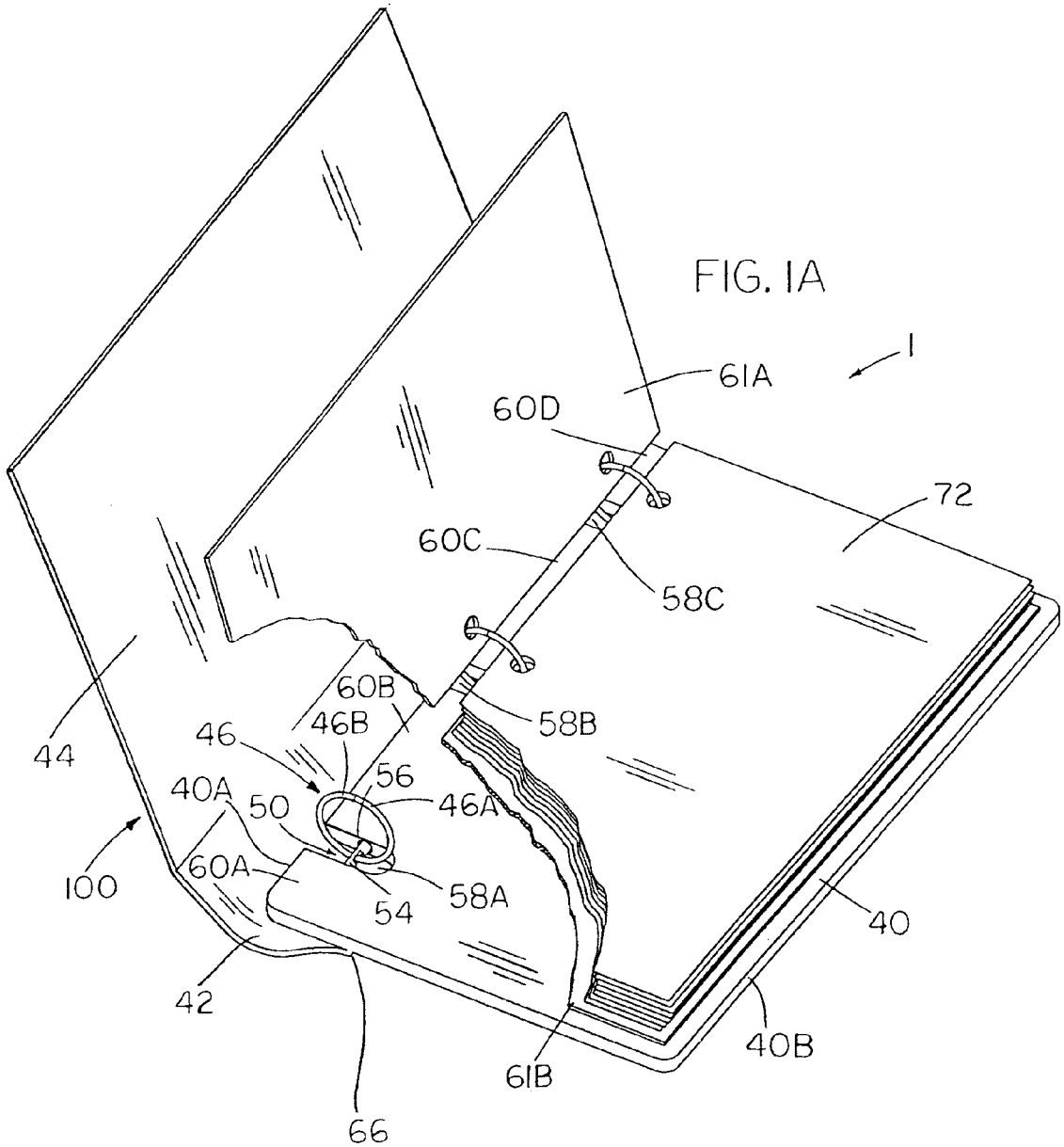
FIG. 1A is a perspective view of an embodiment of the binder of the present invention with its front cover open approximately 120 degrees relative to the back cover in which the spine of the binder skeleton is rotatably disposed.

Various features of each preferred embodiment cooperate to enable its loose-leaves above and below the back cover to lie flat and parallel when the cover is open 360 degrees whether none, one, many, or all of the loose-leaves are flipped below the back cover.

In one embodiment, a binder has a cover, a plurality of oblong binder rings that are each closable from an open position via an interlock closure, a connective element having at least one pivot means for pivoting the oblong binder rings about the main axis of rotation. The connective element joins together and aligns the oblong binder rings along the main axis of rotation. At least one of the oblong binder rings elastically closable from an open position while continually remaining within a single geometric plane. Each of the oblong binder rings has a major diameter and a minor diameter. The main axis of rotation is perpendicular to each of the oblong binder rings and is located adjacent one side of each of the oblong binder rings as divided by the minor diameter. The minor diameter defines an upright ring position when the minor diameter is substantially vertical and the main axis of rotation is located below the major diameter. The pivot means perpendicularly joins the connective element to at least a ring one of the oblong binder rings adjacent one side of a bottom portion thereof enabling the ring one to stand upright when the pivot means is horizontal. The oblong binder rings maintain an oblong shape whenever closed such that the major diameter is preferably always at least 1.5 times longer than the minor diameter whenever the oblong binder rings are closed and are subject to normal usage. The cover enwraps and shields most of the perimeter of each of the oblong binder rings when the cover is closed such that each of 270 rays emanating from the center of a first ring of the oblong binder rings is spaced at consecutive 1-degree angular increments and intersects the perimeter of the first ring and subsequently intersects the cover when the cover is closed. The cover is folded in a substantially flat formation with a near-ring edge adjacent the oblong binder rings when the cover is open 360 degrees. A portion of each of the oblong binder rings rotatable about the near-ring edge. The main axis of rotation is roughly axially disposed relative to opposing rotations of the cover and the ring one while the ring one remains closed, such that the arrangement of the pivot means with the oblong binder rings facilitates limited rotational attachment of the oblong binder rings to the cover, enables the cover to be extra thin when closed thus saving storage space, enables nimble page-turning of ring-bound loose-leaves when the cover is open 180 degrees, and reduces the amount of necessary rotation of the oblong binder rings when ring-bound loose-leaves are stack substantially flat above and below the pivot means when the cover is open 360 degrees.

In another embodiment, the loose-leaf binder is composed of a cover, a plurality of oblong binder rings that are each elastically closable from an open position via an interlock closure, at least one elastic pivot, and at least one flat orthogonal base. Each of the oblong binder rings has a major diameter and a minor diameter. The minor diameter defines an upright ring position when the minor diameter is substantially vertical. The cover has an inner surface and outer surface when closed. The flat orthogonal base is affixed flatly to the inner surface of the cover. The flat orthogonal base is attached to at least ring one of the oblong binder rings via the elastic pivot enabling the ring one to stand upright when the flat orthogonal base is horizontal. The cover is made up of a back cover, a middle cover, and a front cover, where the middle cover joins the back cover to the front cover. The back cover is separated from the middle cover by an edge-fold. The flat orthogonal base and the ring one straddle the edge-fold. The middle cover supports the ring one when the middle cover is extended flatly away from the back cover on a flat surface. The cover enwraps and shields most of the perimeter of each of the oblong binder rings when the cover is closed such that each of 270 rays emanating from the center of a first ring of the oblong binder rings is spaced at consecutive 1-degree angular increments and intersects the perimeter of the first ring that subsequently intersects the cover when the cover is closed. The cover is folded in a flat formation with the edge-fold adjacent the oblong binder rings when the cover is open 360 degrees A portion of each of the oblong binder rings rotatable about the edge-fold when the cover is open 360 degrees.

In another embodiment, the loose-leaf binder is composed of a plurality of binder rings, a cover (comprising a front cover and a back cover), a primary fold, and at least one fold-intersecting ring-crush resister. The primary fold is located between the front cover and the back cover when the cover is extended flatly open 180 degrees. The primary fold dividing into two folds that border opposite sides of an area of the cover to define the fold-intersecting ring-crush resister. The fold-intersecting ring crush resister disposed adjacent to at least a ring one of the binder rings. The fold-intersecting ring-crush resister is roughly perpendicular to the front cover and the back cover when the cover is folded closed along the primary fold, whereby the fold-intersecting ring-crush resister acts as a physical obstacle to oppose excessive deformation of adjacent the ring one caused by large compressive forces exerted on exterior surfaces of the cover when the cover is closed.

In yet another embodiment, the loose-leaf binder is composed of a skeleton having a spine and a plurality of oblong binder rings and an instant user-affixed adhesive attachment for attaching the spine to a surface. The skeleton is a single piece of molded plastic and each of the oblong binder rings has an interlock closure and is closable from an open position. Each of the oblong binder rings has a major diameter, a minor diameter and a ring perimeter when closed, the interlock closure comprises a tab and a slot. The tab fits substantially flush within the slot so as not to protrude substantially beyond the ring perimeter enabling ring-bound loose-leaves to slide along the ring perimeter unobstructed by the tab and the slot. The spine has a substantially planar portion, which has the instant user-affixed adhesive attachment. The minor diameter defines an upright ring position when the minor diameter is substantially vertical. The spine perpendicularly attached to each of the oblong binder rings allows each of the oblong binder rings to stand upright when the planar portion of the spine is horizontal, whereby the instant user-affixed adhesive attachment offers ready, quick and easy mounting of the skeleton upon a user-selected complementary cover such as a file folder. Special shape of the oblong binder rings facilitates attachment thereof to the complementary cover that is extra thin to save storage space while preserving nimble page-turning of ring-bound loose-leaves when the complementary cover is open 180 degrees. Flush fitting of the tab and the slot eases ring closure and improves the oblong binder ring appearance.

In another embodiment, the pivot means of the binder has an elastic pivot and a flat orthogonal base. The elastic pivot is disposed between the flat orthogonal base and the ring one. The flat orthogonal base is disposed adjacent the near-ring edge of the cover.

In yet another embodiment, the pivot means of the cover of the binder has a conduit and a spine. The spine is rotatably disposed in the conduit as a pivot about which the cover is rotatable. The conduit is disposed adjacent to the near-ring edge.

In another embodiment, the pivot means of the binder has an elastic pivot. In this embodiment, the cover, the connective element, and oblong rings are formed of a single piece of molded plastic such that the connective element is fused with the cover and the oblong rings extend from the cover via at least one elastic pivot.

In another embodiment, at least one of the oblong binder rings of the binder has a protruding paper-catch ring-edge and/or has a flip-top hinge.

In another embodiment, each of the binder rings has roughly-vertical column-like stiff portions when situated in the upright ring position; has a roughly-horizontal bow-like flexible upper portion when situated in the upright ring position; has a roughly-horizontal lower portion when situated in the upright ring position; is reversibly compressible relative to a moderate compressive force roughly exerted in the direction of the minor diameter such that the column-like stiff portions resist permanent buckling while the bow-like flexible upper portions more readily flatten and widen outward to provide much of desired reversible vertical compressibility. Each of the binder rings springs back to resume a relaxed expanded form upon removal of the moderate compressive force.

In yet another embodiment, each of the binder rings has an oblong perimeter having a major diameter and a minor diameter, the primary cover fold comprises a pair of folds effectively acting as one fold; distance between the pair of folds less than half of the minor diameter, maximum distance between the two folds that border opposite sides of the area of the cover preferably greater than half of the minor diameter.

FIGS. 1A-1H

Figure 1B:
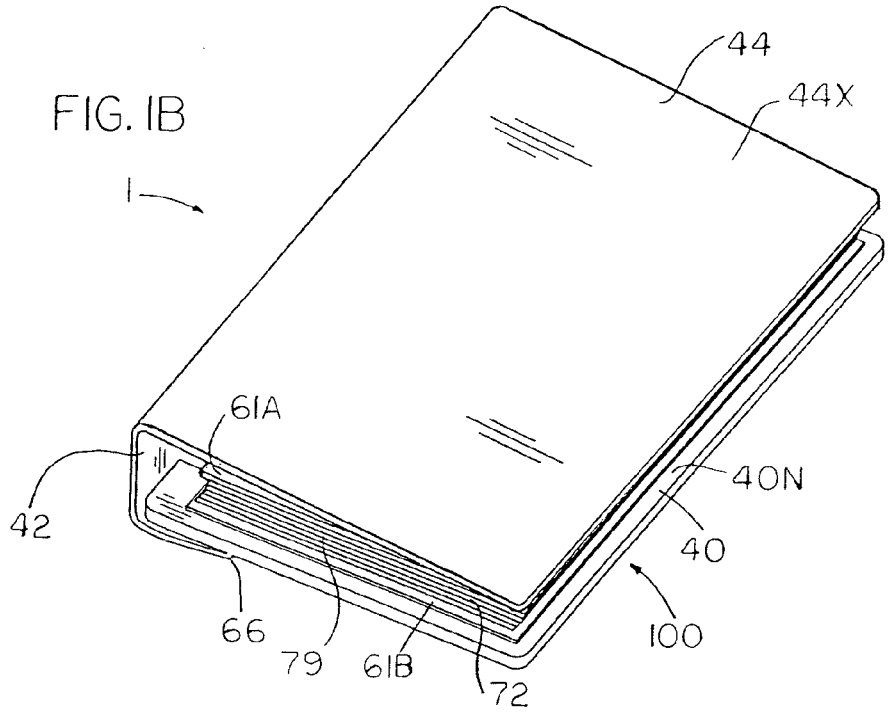
FIG. 1B is a perspective view of the binder of FIG. 1A in its closed position.
Figure 1C:
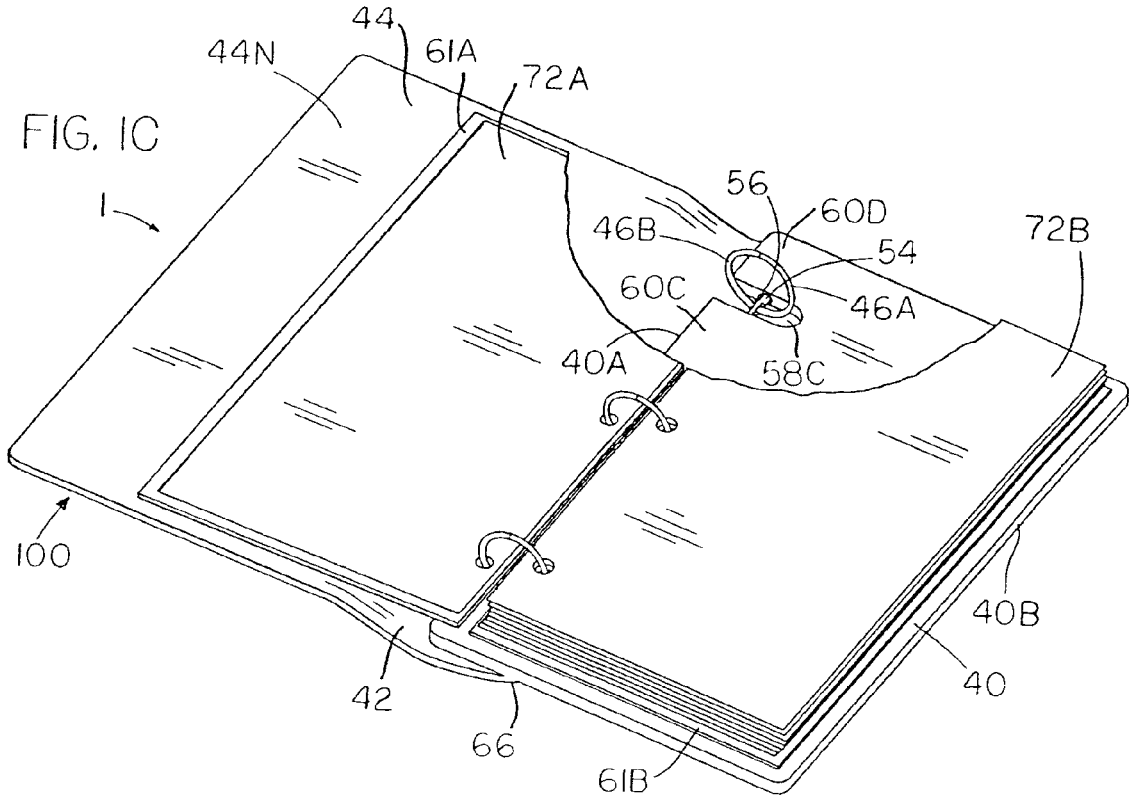
FIG. 1C is a perspective view of the binder of FIG. 1A with the front cover and forward loose-leaf pages flipped 180 degrees open relative to the back cover.
Figures 1G, 1H:
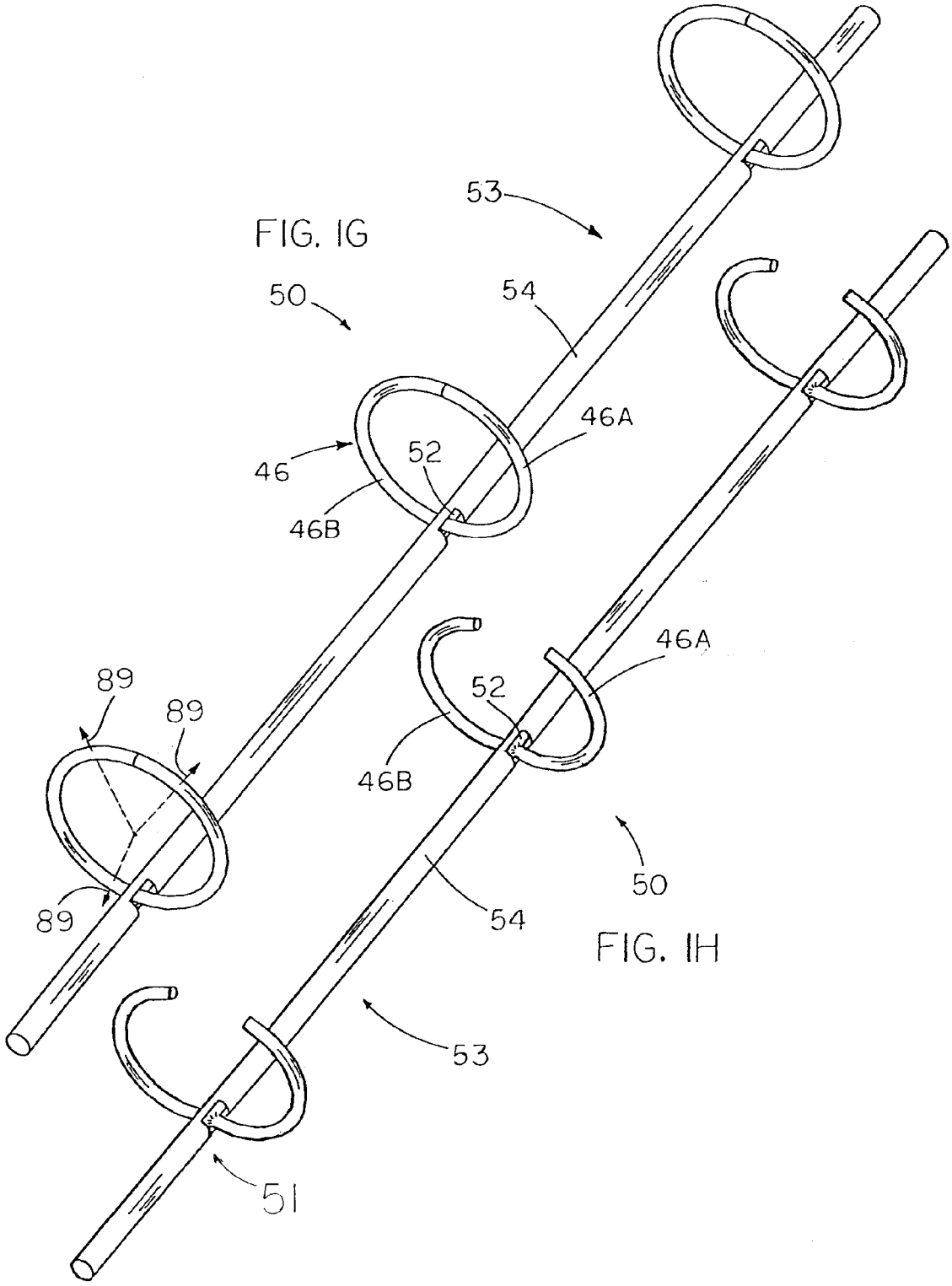
FIG. 1G is a perspective view of the skeleton of FIG. 1A with the rings closed.
FIG. 1H is a perspective view of the skeleton of FIG. 1A with the rings open.

A preferred embodiment of the binder 1 of the present invention is illustrated in FIGS. 1A-1D (perspective views of the binder 1 open 120 degrees, 0 degrees, 180 degrees, and 360 degrees, respectively), FIGS. 1E-1F (bottom views of the binder 1 open 360 degrees), and FIGS. 1G-1H (perspective views of the skeleton 50 of the binder 1). The binder 1 comprises cover 100 and skeleton 50 with optional loose-leaf writing-support pads 61A and 61B.

Cover 100 includes back cover 40, middle cover 42, and front cover 44. Back cover 40 has interior surface 40N and exterior surface 40X and front cover 44 has interior surface 44N and exterior surface 44X. Back cover 40, middle cover 42 and front cover 44 are typically made of cardboard, plastic, or other semi-rigid material that is optionally covered by a more flexible material such as vinyl or leather, but may be composed of any materials used to manufacture binder covers, loose-leaf flip-chart covers, loose-leaf personal organizer covers, or loose-leaf writing-pad covers.

Skeleton 50 comprises the spine 53 and a plurality of rings 46. Rings 46 have ring segments 46A and 46B. Spine 53 includes tube 54 and inner rod 52. Ring segments 46B are disposed on tube 54 and ring segments 46A, complementary with ring segments 46B, are disposed on inner rod 52. Spine 53 has a synchronized switching element 51 that simultaneously opens or simultaneously closes ring segments 46A relative to ring segments 46B. Ring segments 46A and ring segments 46B are disposed perpendicular to spine 53.

Conduit 56 is defined by the back cover 40 and is proximate to and runs substantially parallel with the edge 40A of back cover 40. The spine 53 of the skeleton 50 is rotatably disposed within conduit 56. Spine 53 is a pivot about which back cover 40 can rotate. Rings 46 are constrained to rotate with spine 53. Because spine 53 is a pivot of back cover 40 and rings 46 rotate with spine 53, spine 53 is axially disposed relative to opposite rotations of back cover 40 and rings 46. Slots 58A-58C are cut perpendicularly into the edge 40A of back cover 40. Back cover 40 defines paper margin supports 60A-60D. The purpose of slots 58A-58C which intersect conduit 56 and that of margin supports 60A-60D will become apparent in the explanation of the operation of the binder 1.

The rings 46 are aligned with their respective slots 58A-58C so that at least a portion of each of the rings 46 is both received in and protrudes from one of the slots 58A-58C and thereby allowing spine 53 to be rotatably disposed within the back cover 40. Preferably, the tube 54 of spine 53 is constructed to have a relatively small cross-sectional dimension so that back cover 40 need not be unduly thick to define a conduit 56 large enough to receive the tube 54. Preferably, the cross-sectional dimension of tube 54 ranges from about 4 mm to about 9 mm and more preferably from about 4 mm to 7 mm.

One edge of middle cover 42 merges into the plane of back cover 40 along seam 66 which is parallel to conduit 56. Seam 66 can be located between conduit 56 and the far parallel edge 40B of back cover 40 but is preferably located near conduit 56 without intersecting slots 58A-58C. The other edge of middle cover 42 interfaces to an edge of front cover 44. There need not be a distinct boundary distinguishing middle cover 42 and front cover 44, but often there is one in the form of a seam, crease, or hinge. Optional pads 61A and 61B can be placed loose-leaf on rings 46 between which loose-leaves 72 may be added. The binder 1 has a loose-leaf stack space 79 which is the space available for occupation by loose-leaves 72 concurrently bound on rings 46 when the cover 100 is closed.

FIGS. 1G-1H show perspective views of skeleton 50 and its components. FIGS. 1G and 1H are perspective views of the skeleton 50 with rings 46 closed and open, respectively. A plurality of ring segments 46A are attached to rod 52 via a weld, braze, adhesive or other appropriate means; similarly, a corresponding number of ring segments 46B are attached to tube 54. When rod 52 is assembled within tube 54, the spaced ring segments 46A protrude through similarly spaced slots 55 defined by tube 54. Preferably, the width of slots 55 approximates the cross-sectional diameter of ring segments 46A, or guide mechanisms of some type—such as cylindrical grooves cut into the inner surface of tube 54 with complementary cylindrical flanges attached to rod 52—are provided to constrain rod 52 from moving longitudinally relative to tube 54. Slots 55 are cut long enough to enable tube 54 to concentrically rotate about rod 52 through a limited angle without interference from ring segments 46A. Tube 54 can be rotated about rod 52 to open or close ring segments 46A relative to ring segments 46B. In this embodiment of a skeleton 50, rod 52 and tube 54 serve as first and second connective elements, respectively, of synchronized switching element 51. Rod 52 is rotated relative to tube 54 to open or close rings 46 together.

There are four fundamental operations of the binder 1, (i) opening or closing front cover 44 relative to back cover 40 to see and access the contents of the binder 1; (ii) writing on loose-leaf sheets; (iii) opening or closing rings 46 to insert or remove loose-leaf items such as paper and pocket folders; and (iv) handling and storage of the binder including carrying it in hand, standing it on a bookshelf, packing it in briefcases or bookbags, and stacking it horizontally.

The binder 1 is opened like a book from its closed position (FIG. 1B) by spreading its front cover 44 and back cover 40 apart (FIG. 1A) and, in so doing, usually rotating middle cover 42 relative to back cover 40 and front cover 44. As shown in FIGS. 1D-1F, the front cover 44 and forward loose-leaves 72A can be disposed flatly beneath the back cover 40 of binder 1 and latter loose-leaves 72B to minimize the footprint of the binder 1 during use. When front cover 44 and forward loose-leaves 72A are pulled beyond 180 degrees relative to back cover 40, skeleton 50 is able to rotate to accommodate this extended range of motion and thus prevents stress on loose-leaves 72 that could cause them to tear out of the rings 46. The rotation of skeleton 50 also enables forward loose-leaves 72A to lay flat against front cover 44 to provide flat writing surfaces when the binder 1 is open 360 degrees (FIGS. 1E and 1F).

Open slots 58A-58C are defined by the back cover 40 which allow the rings 46 to (i) stand upright when the back cover 40 is closed and (ii) rotate along with the skeleton 50. When the binder is open 180 degrees, skeleton 50 is able to rotate several degrees, typically 5-20 degrees, relative to its upright position because of slots 58A-58C in back cover 40 but is stopped from rotating further by middle cover 42 which presses up against slots 58A-58C when the middle cover 42 is supported by a flat surface. Since middle cover 42 is connected to back cover 40 between conduit 56 and the far parallel edge 40B of back cover 40, when front cover 44 is open 360 degrees relative to back cover 40, middle cover 42 is pulled away from slots 58A-58C and allows for maximum rotation of the rings 46 through the slots 58A-58C. When cover 100 is folded open 360 degrees in a flat formation, a portion of each ring 46 is rotatable about near-ring edge 40A, the pertinence of which is explained below. The angle of rotation of skeleton 50 from its upright position is determined by the relative number of forward loose-leaves 72A flipped beneath back cover 40 to latter loose-leaves 72B; i.e. the more loose-leaves 72 flipped beneath, the greater is the angle of rotation of skeleton 50 from its upright position. Other factors determining the angle that skeleton 50 rotates from its upright position are the diameter of rings 46, the thickness of back cover 40, and whether the binder is placed on a surface with the back cover 40 over front cover 44 (FIG. 1E) or vice versa (FIG. 1F).

A portion of each ring 46 being rotatable about near-ring edge 40A of the flatly-folded cover 100 serves two purposes: (1) it enables loose-leaves 72 to clear edge 40A as they are moved from one side of the back cover 40 to the other side while bound on rings 46 and (2) it enables a first variable segment of each ring 46 to be located on the interior side of back cover 40 while a second variable segment of each ring 46 is concurrently located on the exterior side of back cover 40 which is necessary to enable loose-leaves 72 stacked flatly and bound on rings 46 above back cover 40 to be substantially parallel to loose-leaves 72 stacked flatly and bound on rings 46 below back cover 40. For purpose (2) above to be possible, the inner diameter of each ring 46 must be greater than the thickness of the flat formation of cover 100 which equals the sum of the thicknesses of front cover 44 and back cover 40 which are placed together when cover 100 is open 360 degrees in the flat formation.

The front cover 44 may be flexible enough or may have a fold or hinge such that it may be folded against itself while it is flipped back against back cover 40 in order to further reduce the footprint of the binder 1.

FIG. 1C shows that users can write on the front or back of any loose-leaf 72 when the binder 1 is open 180 degrees. Likewise, when front cover 44 and forward loose-leaves 72A are flipped back against back cover 40 and latter loose-leaves 72B, the user can write on either the front side of the exposed latter loose-leaf 72B or the back side of the exposed forward loose-leaf 72A by positioning the binder as illustrated in FIGS. 1E and 1F, respectively. In this manner, the binder 1 of the present invention allows the user to write on the front or back of any loose-leaf 72 with the minimal binder footprint.

Whenever skeleton 50 is rotated from its upright position, the margin supports 60A-60D provide support for writing so that almost the entire surface of loose-leaves 72 from left edge to right edge and from top to bottom can be written upon. Pads 61A-61B which also assist in this writing-support effort are likely to be only semi-rigid and thus benefit from the added support of margin supports 60A-60D in providing a flat, well-supported, writing surface. The support provided by both margin supports 60A-60D and loose-leaf writing-support pads 61A-61B help to prevent puncturing loose-leaves 72 during writing.

Rotatably disposing spine 53 of skeleton 50 within back cover 40, outside of the loose-leaf stack space 79, provides for a flat writing surface when front cover 44 and any forward loose-leaves 72A are rotated either 180 degrees with respect to back cover 40 or approximately 360 degrees against the underside of back cover 40 and latter loose-leaves 72B. Spine 53 must be able to rotate with respect to the back cover 40 and be planar therewith in order to avoid the creation of uneven writing surfaces.

Skeleton 50 of FIG. 1A includes a synchronized switch element 51 to simultaneously open all rings 46 to an open state (FIG. 1H) or to simultaneously close all rings 46 to a closed state (FIG. 1G). Opening skeleton 50 involves separating the interfacing free ends of ring segments 46A and ring segments 46B which permits the reception or removal of the loose-leaf sheets (FIG. 1H). Closing skeleton 50 involves adjoining the free ends of ring segments 46A and ring segments 46B to form completely closed rings 46 that secure the loose-leaf sheets within the binder (FIG. 1G).

To open skeleton 50, any two opposing ring segments 46A and 46B are pulled apart by the user's fingers. This action triggers the synchronized switch element 51 to open all of the rings 46 simultaneously. A detailed mechanism showing additional components that enable synchronized switching element 51 to maintain rings 46 in a stable open state or stable closed state is disclosed in U.S. Pat. No. 6,371,678 (Chizmar). To close skeleton 50, any two opposing ring segments 46A and 46B are pushed together by the user's fingers which again triggers the synchronized switching element 51 to close all of the rings 46 simultaneously.

The binder cover 100, when closed, almost completely encompasses loose-leaves 72 and skeleton 50 including rings 46 and thus resembles a book. The encompassing is such that each of 270 rays emanating from the center of one of the rings 46 and spaced at consecutive 1-degree angular increments and intersecting the perimeter of that ring 46 subsequently intersects the cover 100 when the cover 100 is closed. Consequently, it is easier to stand the binder 1 on a shelf, it is less awkward to carry, it is easier to store in containers such as book shelves, brief cases, and back packs, it is more attractive, and it provides more protection to the loose-leaf pages 72 than a binder with a less enveloping cover, such as those with exposed rings.

FIGS. 2A-2E

FIGS. 2A-2E show perspective and sectional views of another preferred embodiment of a binder 2 of the present invention. The binder 2 comprises cover 200 and skeleton 50. Cover 200 includes front cover 144, middle cover 142, and back cover 40. The binder 2 comprises the same back cover 40 and skeleton 50 as the binder 1 shown in FIGS. 1A-1H, but incorporates a different middle cover 142 and front cover 144. Front cover 144 defines holes 74A for receiving rings 46 thereby enabling front cover 144 to be releasably bound by rings 46 in the same manner that loose-leaves 72 are releasably bound by the rings 46. Front cover 144 is connected to middle cover 142 via seam 166 which is disposed between holes 74A and the far parallel edge 144A of front cover 144. The preferred location of seam 166 is nearer holes 74A than the far edge 144A of front cover 144. Middle cover 142 has crease 80 and crease 82 and connects to back cover 40 as in the binder 1 as shown in FIGS. 1A-1C.

Figure 2A:
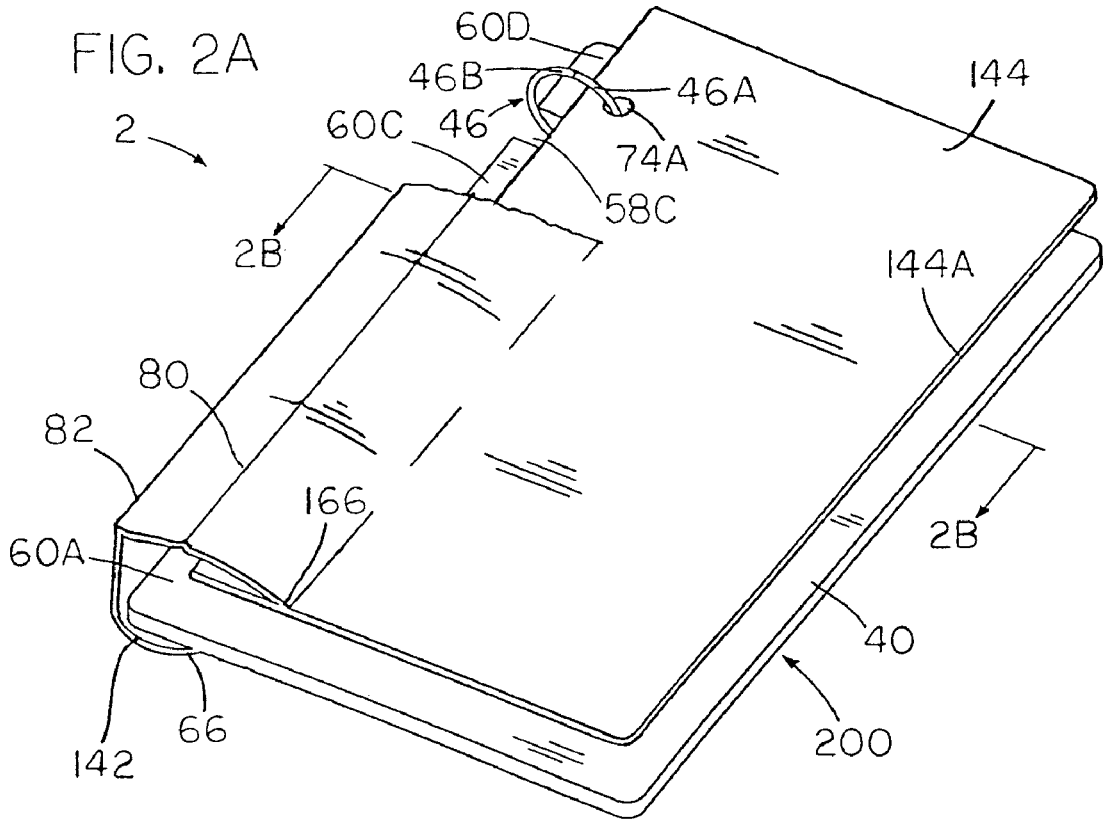
FIG. 2A is a perspective view of another embodiment of the binder in the closed position where its front cover rides loose-leaf on its rings but is also connected to its middle cover by an attachment seam that is exterior to the binder rings.
Figure 2B:
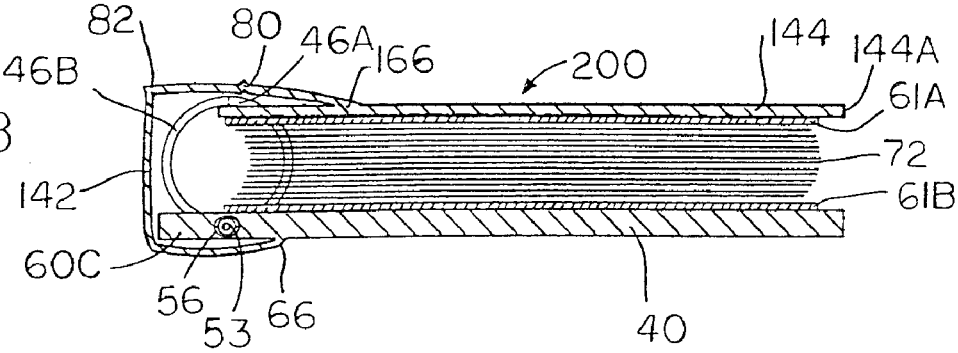
FIG. 2B is a cross-sectional view of FIG. 2A indicated by the section lines 2B-2B in FIG. 2A.
Figure 2C:
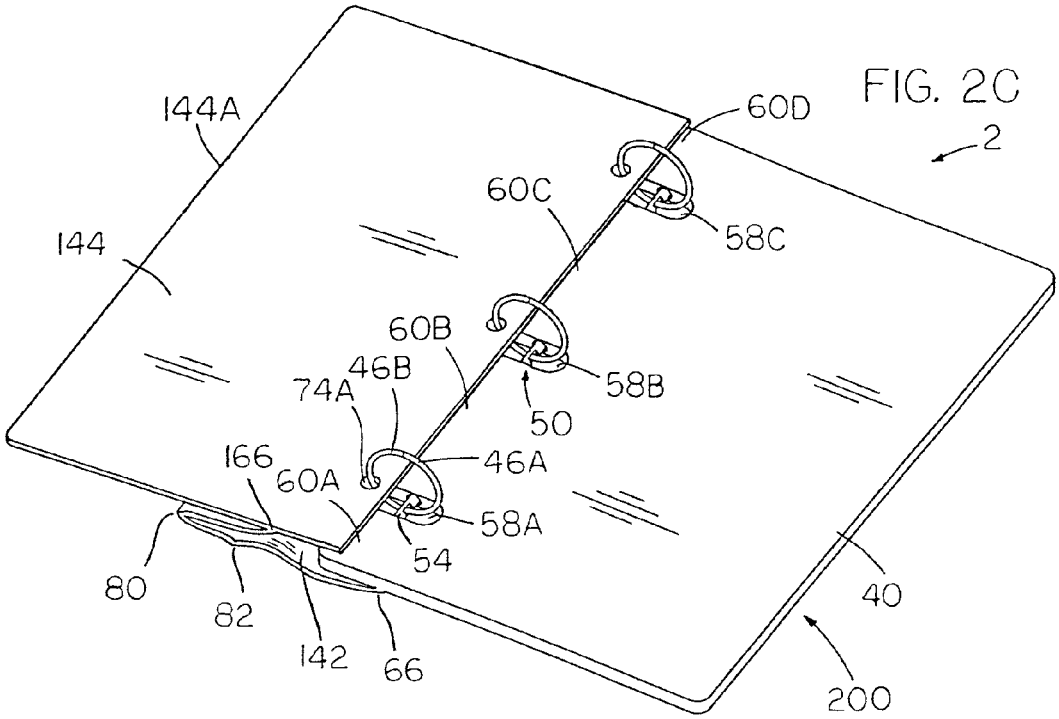
FIG. 2C is a perspective view of the binder of FIG. 2A with loose-leaf pages removed and with the front cover flipped 180 degrees open relative to the back cover while the middle cover folds along an 180-degree-open crease.
Figure 2D:
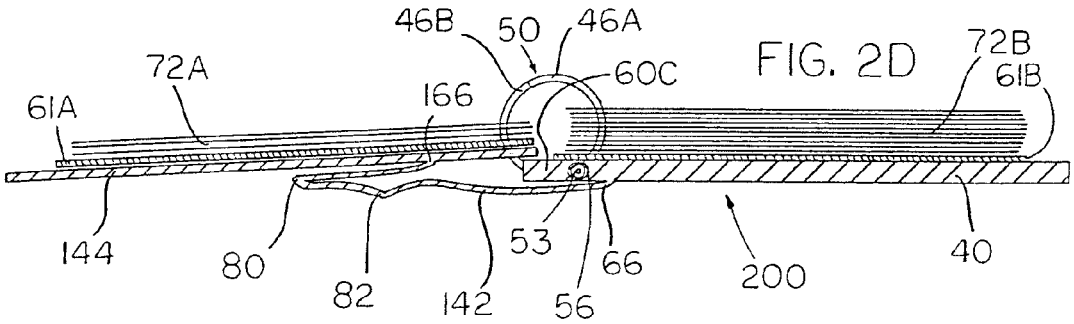
FIG. 2D is the cross section of FIG. 2B where the front cover and forward loose-leaf pages have been flipped 180 degrees open relative to the back cover and the middle cover folds along a 180-degree-open crease.
Figure 2E:
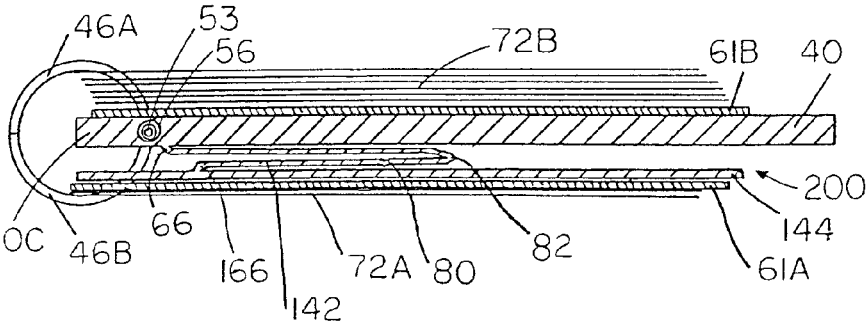
FIG. 2E is the cross section of FIG. 2B where the front cover and forward loose-leaf pages have been flipped 360 degrees flatly beneath the back cover and latter loose-leaf pages and the middle cover folds along a 360-degree-open crease.

Because front cover 144 rides loose-leaf on rings 46, rings 46 constrain the motion of front cover 144. When the binder 2 is opened 180 degrees and placed on a surface or when the binder 2 is opened 360 degrees, rings 46 constrain front cover 144 which in turn forces middle cover 142 to fold upon itself. To encourage smooth folding with a minimal resulting lump, creases 80 and 82 are preferably formed in middle cover 142. When the binder 2 is opened 180 degrees, middle cover 142 tends to fold along crease 80 and when the binder 2 is opened 360 degrees, middle cover 142 tends to fold along crease 82. For illustrative purposes, middle cover 142 has noticeable thickness in FIGS. 2A-2E; in practice middle cover 142 can be paper-thin to minimize any lump it creates when the binder 2 is open 360 degrees. FIG. 2E shows the minimal resulting footprint of the binder 2 provided when cover 200 is open 360 degrees in a flat formation between forward loose-leaves 72A and latter loose-leaves 72B. For purpose (2) recited earlier in the description of the binder 1 shown in FIGS. 1A-1F, the inner diameter of rings 46 is substantially greater than the thickness of the flat formation of cover 200 which equals the sum of the thickness of back cover 40 plus the thickness of front cover 144 plus twice the thickness of middle cover 142.

Another advantage of the binder 2 of the present invention is more compact storage due to less wasted interior space of the binder. Since front cover 144 rests flatly on loose-leaves 72 when the binder is closed (FIGS. 2A and 2B), there is no air pocket between the top loose-leaf 72 and front cover 144. This advantage is significant when considering the limited space of a briefcase or bookbag. The binder 2 of the present invention provides the advantages of an enveloping cover for the rings 46 while creating only a minimal footprint when opened approximately 180 degrees or 360 degrees.

FIGS. 3A-3E

FIGS. 3A-3E are bottom views of yet another preferred embodiment of a binder 23 of the present invention. The binder 23 comprises skeleton 550, one or more staple-thin fasteners 68 and cover 2300. Cover 2300 includes front cover 1144, middle cover 1842 and back cover 1640. Middle cover 1842 has middle cover portions 1842A-1842C. Skeleton 550 includes spine 553 and rings 746.

Figure 3A:
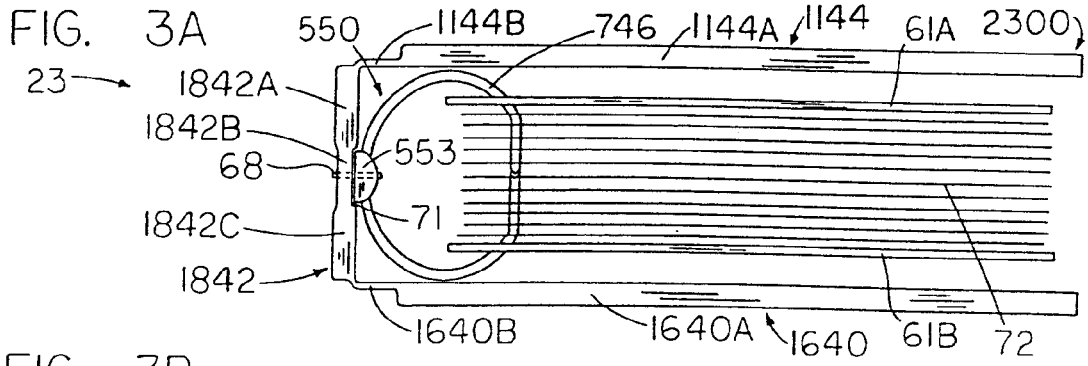
FIG. 3A is a bottom view of another embodiment of the binder in a closed position having a flexible middle cover and a skeleton with a conventional arc-shaped spine which is firmly attached to the cover via a staple-thin rivet and is able to rotate via the flexibility of the middle cover.
Figure 3B:
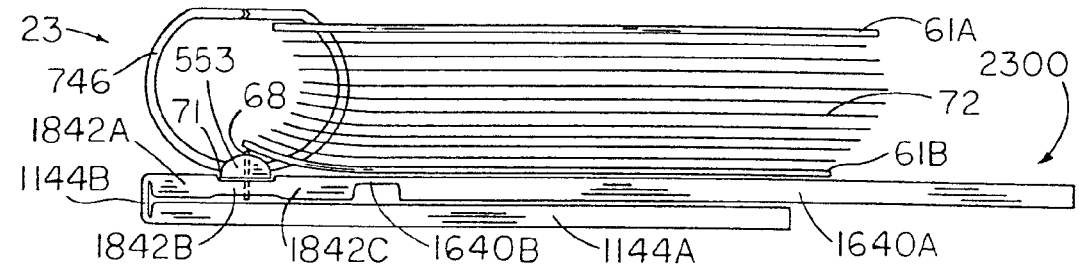
FIG. 3B is a bottom view of the binder of FIG. 3A with its front cover open 360 degrees and with all its loose-leaves resting above the back cover.
Figure 3C:
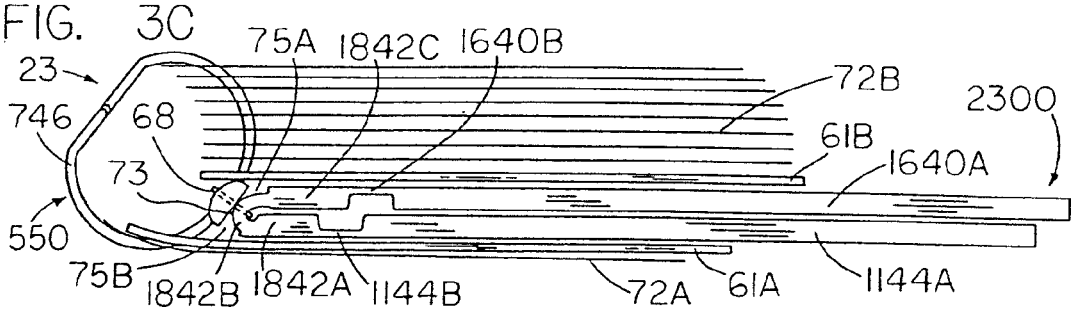
FIG. 3C is a bottom view of the binder of FIG. 3A, but with its front cover, a writing-support pad, and one forward loose-leaf flipped beneath the back cover and latter loose-leaves.
Figure 3D:
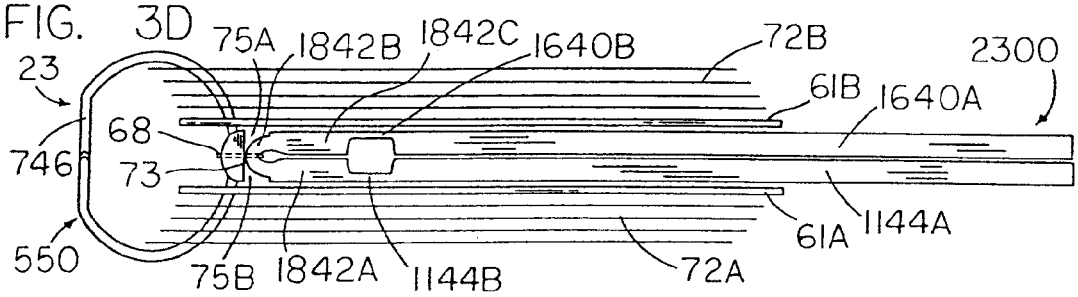
FIG. 3D is a bottom view of the binder of FIG. 3A, but with its front cover, a writing-support pad, and half the loose-leaves flipped beneath the back cover and remaining half of the loose-leaves.
Figure 3E:
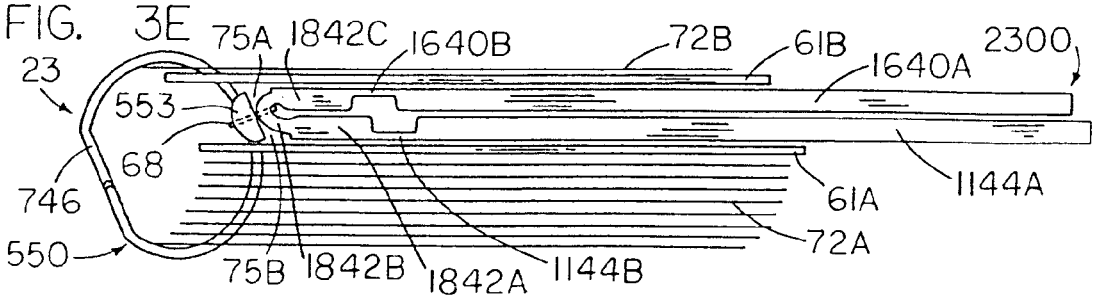
FIG. 3E is a bottom view of the binder of FIG. 3A, but with its front cover, a writing-support pad, and all but one forward loose-leaf flipped beneath the back cover and the one remaining latter loose-leaf.

Conventional spine 553 has an arc-shaped cross-section and has a switching element to simultaneously open and close rings 746. Skeleton 550 is fixed to middle cover portion 1842B via one or more staple-thin fasteners 68. Middle cover portion 1842B is of reduced thickness relative to middle cover portion 1842A and middle cover portion 1842C preferably creating recess 71 to contain spine 553. Recess 71 aids in providing a flat writing surface when the binder 23 is open 180 degrees by lowering spine 553 partially into the plane of front cover 1144 and back cover 1640. The reduced thickness of middle cover portion 1842B also facilitates its greater flexibility relative to middle cover portions 1842A and 1842C enabling it to have a small radius of curvature illustrated in FIGS. 3C-3E such that middle cover portion 1842A is able to lie flatly against middle cover portion 1842C. Furthermore, fastener 68 is purposefully staple-thin so as not to hinder the folding of middle cover 1842. The folding of middle cover 1842 creates a transient near-ring edge 73 in cover 2300. To facilitate the flipping of front cover 1144 and one or more forward loose-leaves 72A 360 degrees such that they lie parallel to back cover 1640 and latter loose-leaves 72B, skeleton 550 must be able to incrementally rotate in a stable and controlled manner relative to front cover 1144 and back cover 1640. Because skeleton 550 is fastened to middle cover portion 1842B, it cannot freely rotate relative to middle cover portion 1842B; but skeleton 550 rotates relative to front cover 1144 and back cover 1640 via the flexibility of middle cover portion 1842B. As illustrated in FIGS. 3C-3E, skeleton 550 is not strongly biased to a particular angular position when front cover 1144 is flipped 360 degree beneath back cover 1640 and can incrementally rotate as needed depending upon the number of forward loose-leaves 72A to be flipped beneath back cover 1640; back cover 1640 and middle cover portion 1842A slide against front cover 1144 and middle cover portion 1842B to facilitate the amount of necessary rotation of skeleton 550. Staple-thin fasteners 68 can be affixed loosely to allow freer rotation of skeleton 550 relative to middle cover portion 1842B. To provide a flat writing surface, writing-support pads 61A and 61B blanket crevices 75A-75B between spine 553 and middle cover portions 1842A and 1842C, respectively.

When cover 2300 is open 360 degrees, spine 553 is rotatably disposed on middle cover 1842 such that rings 746 of skeleton 550 can rotate about near-ring edge 73 of the flatly-folded cover 2300. Since spine 553 is riveted to cover 2300, it is not a pivot about which cover 2300 can rotate. However, when the binder 23 is flatly folded open 360 degrees, the flexibility and small radius of curvature of middle cover 1842 enable spine 553 to be substantially axially disposed relative to the rotation of rings 746 and the oppositely rotating front cover 1144 and back cover 1640. All points of front cover 1144, back cover 1640, and rings 746 rotate through substantially the same size angle about spine 553 as most of the flatly-folded cover 2300 rotates about spine 553. In this case, front cover 1144 and back cover 1640 share the same angular rotation about spine 553 even though front cover 1144 and back cover 1640 slide radially in opposite directions relative to spine 553.

Front cover 1144 comprises front cover portions 1144A-1144B and back cover 1640 comprises back cover portions 1640A-1640B. Front cover portion 1144B is of reduced thickness enabling the folding of front cover portion 1144A beneath middle cover 1842 and back cover 1640 as shown in FIG. 3B. Likewise, back cover portion 1640B is of reduced thickness enabling the folding of back cover portion 1640A beneath middle cover 1842 and front cover 1144.

The binder 23 is similar to the binder 5 in that the thickness of the folded middle cover 1842 is substantially equal to the sum of the thickness of front cover 1144 and back cover 1640 as seen when the binder is open 360 degrees in FIGS. 3C-3E. Moreover, the LSCPL of spine 553 is less than or equal to sum of the thickness of front cover 1144 and back cover 1640 which minimizes or eliminates any potential lump caused by spine 553 when it is positioned between forward loose-leaves 72A and latter loose-leaves 72B when the binder 23 is open 360 degrees. Also the major diameter of the rings 746 is much larger than the LSCPL dimension of spine 553. The many elements of the binder 23 described in detail above work in concert to enable front cover 1144 and forward loose-leaves 72A to lie flat and parallel to back cover 1640 and latter loose-leaves 72B when the binder 23 is opened 360 degrees.

As the binder 23 is opened from its closed position to its 360 degree position, front cover 1144 and middle cover portion 1842A rotate about middle cover portion 1842B until they abut back cover 1640 and middle cover portion 1842C, respectively, as shown in FIGS. 3C-3E. Middle cover portion 1842A, middle cover portion 1842C, front cover portion 1144A and back cover portion 1640A are preferably the same thickness to form parallel planar surfaces when the binder 23 is open 360 degrees.

Partially elliptical rings 746 have a major diameter that is greater than or equal to the sum of their cut-off minor diameter plus the LSCPL of spine 553. This enables the loose-leaf capacity of rings 746 when the binder 23 is open 360 degrees to be greater than or equal to the capacity of the binder 23 when it is open 180 degrees and is typically loaded.

FIGS. 4A-4C

Figure 4A:
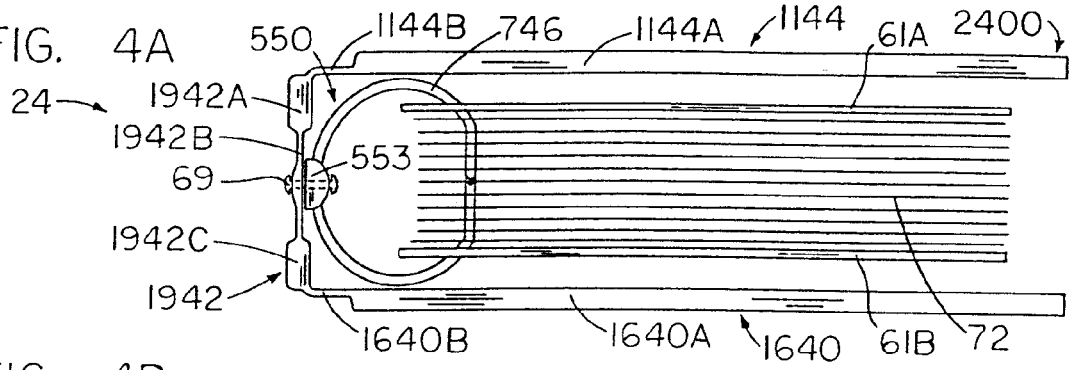
FIG. 4A is a bottom view of another embodiment of the binder in the closed position which is similar to the binder 23 but with a thinner, more flexible middle cover and a conventional round rivet that attaches its skeleton to its middle cover.
Figure 4B:
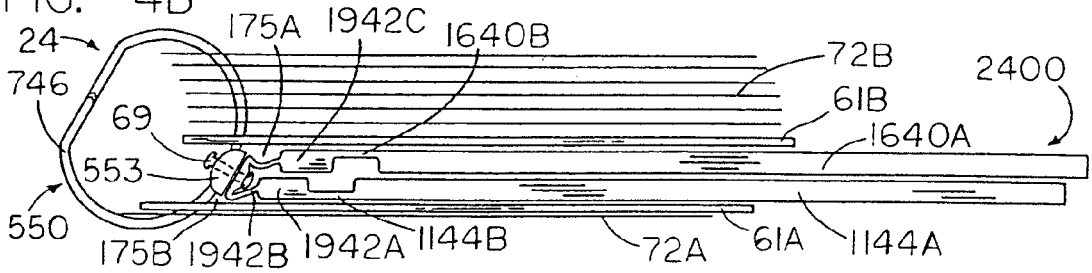
FIG. 4B is a bottom view of the binder of FIG. 4A, but with its front cover, a writing-support pad, and one forward loose-leaf flipped beneath the back cover and latter loose-leaves.
Figure 4C:
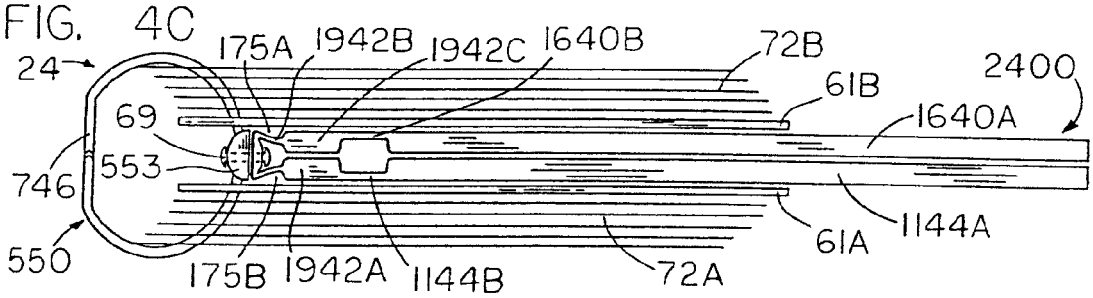
FIG. 4C is a bottom view of the binder of FIG. 4A, but with its front cover, a writing-support pad, and half the loose-leaves flipped beneath the back cover and remaining half of the loose-leaves.

FIGS. 4A-4C are bottom views of yet another preferred embodiment of a binder 24 of the present invention. The binder 24 comprises skeleton 550, one or more round rivets 69, and cover 2400. Cover 2400 includes front cover 1144, middle cover 1942, and back cover 1640. The binder 24 comprises the same skeleton 550, front cover 1144 and back cover 1640 as the binder 23 shown in FIGS. 3A-3E, but incorporates a different middle cover 1942 and round rivets 69 in place of middle cover 1842 and staple-thin fasteners 68 of the binder 23. Skeleton 550 is fixed to middle cover 1942 via round rivets 69. Middle cover 1942 includes middle cover portions 1942A-1942C. Like middle cover portion 1842B, middle cover portion 1942B is of reduced thickness relative to middle cover portions 1942A and 1942C. But middle cover portion 1942B of the binder 24 is longer and thinner than middle cover portion 1842B of the binder 23 which enables middle cover portion 1942B to accommodate round rivets 69 as well as staple-thin fasteners 68. Because middle cover portion 1942B is thin and flexible, middle cover portion 1942B prevents round rivets 69 from causing a lump between middle cover portions 1942A and 1942C by providing the extra room that round rivets 69 require relative to staple-thin fasteners 68. Middle cover portion 1942B is also shaped so as to deter the edges of round rivets 69 from cutting into and damaging middle cover 1942 during repeated usage of the binder 24. To provide a flat writing surface, writing-support pads 61A and 61B blanket crevices 175A-175B between spine 553 and middle cover portions 1942A and 1942C, respectively.

FIGS. 5A-5B

Figure 5A:
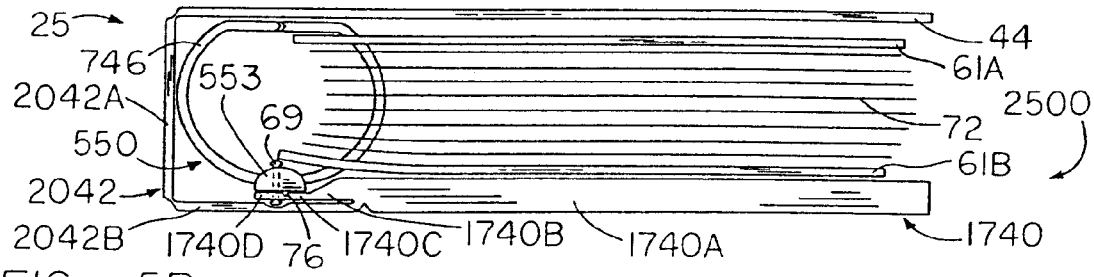
FIG. 5A is a bottom view of another embodiment of the binder in the closed position which has the same skeleton as the binders 23 and 24, but whose skeleton rotates via a hinge joint in its back cover.
Figure 5B:
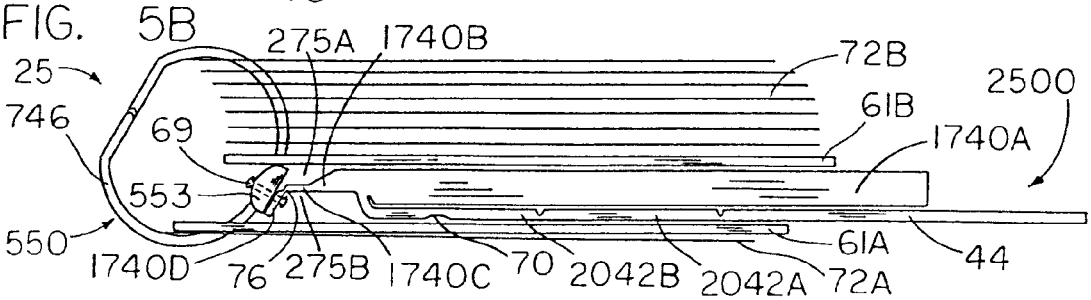
FIG. 5B is a bottom view of the binder of FIG. 5A, but with its front cover, a writing-support pad, and one forward loose-leaf flipped beneath the back cover and latter loose-leaves.

FIGS. 5A-5B are bottom views of yet another preferred embodiment of a binder 25 of the present invention. The binder 25 comprises skeleton 550, one or more round rivets 69, and cover 2500. Cover 2500 includes front cover 44, middle cover 2042, and back cover 1740. The binder 25 has the same skeleton 550 as the binder 23 shown in FIGS. 3A-3E. Back cover 1740 has portions 1740A-1740D. Skeleton 550 is fixed to back cover 1740 via round rivets 69. To facilitate the flipping of front cover 44 and one or more forward loose-leaves 72A 360 degrees such that they lie parallel to back cover 1740 and latter loose-leaves 72B, skeleton 550 must be able to incrementally rotate in a stable and controlled manner relative to front cover 44 and back cover 1740. Because skeleton 550 is riveted to back cover portion 1740D, it cannot freely rotate relative to back cover portion 1740D; but skeleton 550 rotates relative to front cover 44 and most of back cover 1740 via a hinge joint 76 between back cover portions 1740D and 1740C. Thus rings 746 are rotatable about a near-ring edge of back cover portion 1740C. Skeleton 550 is not strongly biased to a particular angular position when front cover 44 is flipped 360 degrees beneath back cover 1740, as illustrated in FIG. 5B. Skeleton 550 can incrementally rotate as needed depending upon the number of forward loose-leaves 72A to be flipped beneath back cover 1740. Spine 553 is substantially axially disposed relative to opposite rotations of large back cover portion 1740A and rings 46. Middle cover 2042 has middle cover portions 2042A-2042B and is attached to the wide side of back cover 1740 as divided by hinge joint 76 such that middle cover 2042 does not interfere with the rotation of skeleton 550 as front cover 44 and forward loose-leaves 72A are flipped beneath back cover portions 1740A-1740C.

Back covers portions 1740C-1740D are of reduced thickness relative to back cover portion 1740A which aids in providing a flat writing surface when the binder 25 is open 180 degrees by lowering spine 553 partially into the plane of back cover portion 1740A. Back cover portion 1740B is a small wedge-shaped segment connecting back cover portion 1740C with back cover portion 1740A. To provide a flat writing surface, writing-support pads 61A and 61B blanket crevices 275A-275B between spine 553 and back cover portion 1740A as illustrated in FIG. 5B. Rivet groove 70 accommodates round rivet 69 when the binder 25 is in its closed position.

The binder 25 is similar to other embodiments of the present invention in that the LSCPL of spine 553 is less than or equal to sum of the thickness of front cover 44 and back cover 1740A which minimizes or eliminates any potential lump caused by spine 553 when it is positioned between forward loose-leaves 72A and latter loose-leaves 72B when binder 25 is open 360 degrees. The binder 25 is also similar to the binder 1 in the manner that its middle cover 2042 is attached to its back cover 1740 to avoid interfering with the rotation of its skeleton 550.

FIGS. 6A-6C

FIGS. 6A-6B show perspective and side views, respectively, of a further preferred embodiment of a skeleton 450 of the binder of the present invention. FIG. 6C shows a side cross-sectional view of the rod 452 of skeleton 450. Skeleton 450 comprises three rings 246 and rod 452. FIG. 6C shows that rings 246 comprise ring segments 246A and ring segments 246B the ends of which define tabs 47 and slots 48, respectively. Also, nubs 49A and nubs 49B protrude from ring segments 246A and ring segments 246B, respectively. Ring segments 246A have a small hollow free end into which tabs 47 can be inserted. Skeleton 450 is assembled by inserting ring segments 246A through holes 57 defined by skeleton 450 and sliding the rings 246 so that only nubs 49A and not nubs 49B pass through light-bulb shaped hole 57. Then each ring 246 is rotated about the portion of ring 246 disposed within hole 57 to stand rings 246 upright relative to rod 452 as shown in FIG. 6A.

Each ring 246 is opened or closed individually. To open ring 246, tab 47 is pushed down relative to slot 48 and pulled out of the hollow tip of ring segment 246A to unhitch tabs 47 from slots 48. The body of ring 246 acts like a spring which is free of tension or compression in its open position as shown in FIG. 6B. To close rings 246, force is exerted to insert tabs 47 of ring segments 246B into slots 48 of ring segments 246A until the tabs 47 are hitched in slots 48 and locked therein by the spring loading of rings 246 that exists when rings 246 are in the closed position. Since the front covers of many of the preferred embodiments of the binders of the present invention often rests on the rings of the skeleton, the rotation of the tops of rings 246 towards skeleton 450 can help minimize binder thickness when the binder is closed.

FIGS. 7A-7F

Figure 7B:
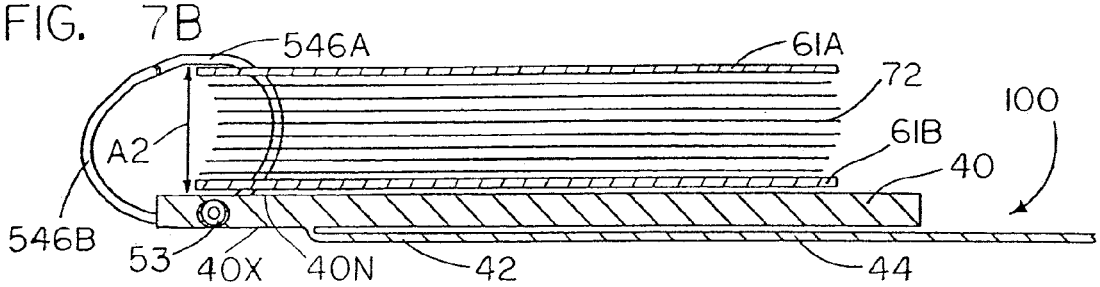
FIGS. 7B-7F are bottom views of the binder of FIG. 1 with its rings replaced with rings of FIG. 7A.
Figure 7C:
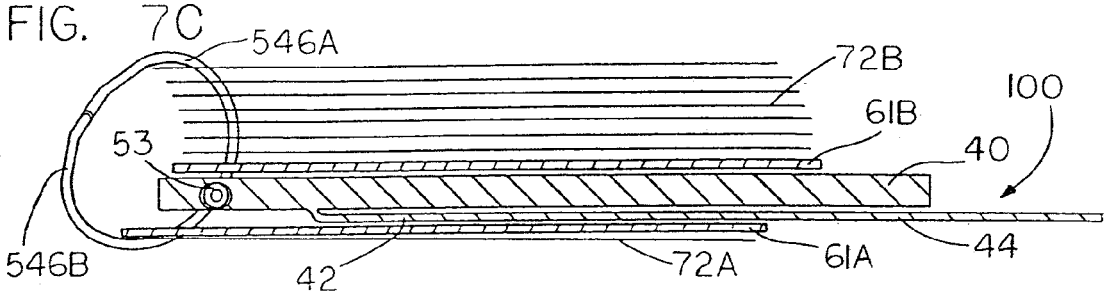
Figure 7D:
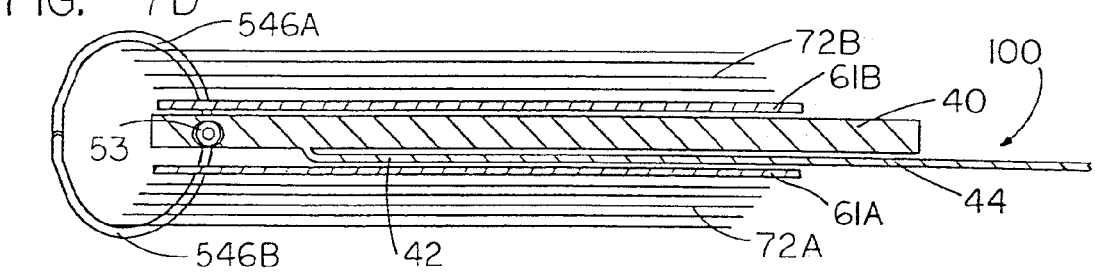
Figure 7E:
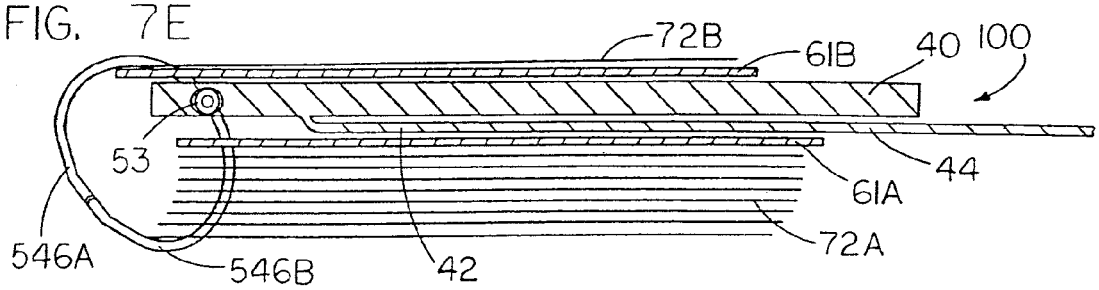
Figure 7F:
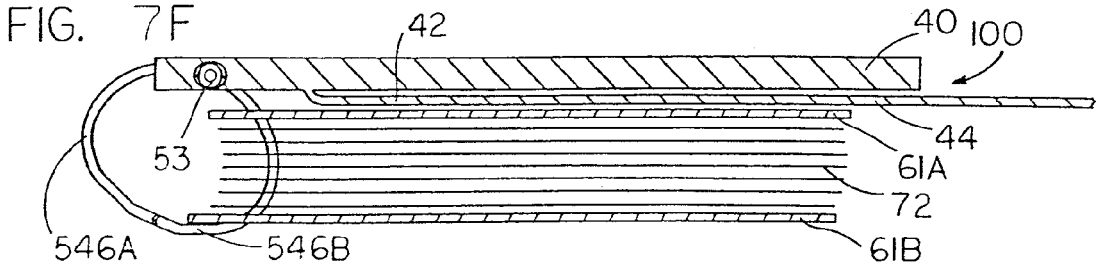

FIG. 7A is the bottom view of another preferred embodiment of a ring component 546 of the present invention and FIGS. 7B-7F are bottom views of binder 1, shown in FIGS. 1A-1H, with its skeleton 50 incorporating rings 546 in placed of rings 46. FIGS. 7B-7F show rings 546 in different positions as varying numbers of forward loose-leaves 72A are flipped beneath back cover 40. Ring 546 comprises ring segments 546A-546B and the portion of spine 53 intersected by ring segments 546A-546B.

Ring segment 546A has ring segments 546P-546R and ring segment 546B has ring segments 546S-546U. Mostly elliptical ring segments 546P and 546S are joined to straight ring segments 546Q and 546T, respectively. Straight ring segments 546Q and 546T are bridged by straight ring segments 546R and 546U to complete rings 546. Straight ring segments 546Q, 546R, 546U, and 546T constitute a multiple-line perimeter segment. The two angles that straight ring segments 546Q and 546T make with the major axis of the partial ellipse of ring 546 are not arbitrary. Straight ring segments 546Q and 546T are made intentionally parallel to lines X1 and Y1, respectively. Line X1 is a tangent line to spine 53 and ring segment 546S and line Y1 is a tangent line to spine 53 and ring segment 546P. When rings 546 are in their upright position, line X1 is in the plane of the exterior surface 40X of back cover 40 and ring segment 546Q is parallel as shown in FIG. 7B. Distance A2 measured from the interior surface 40N of back cover 40 to the under surface of rings segment 546Q is the upright-ring loose-leaf capacity of rings 546. Rings 546 are wider than tall such that the upright-ring loose-leaf capacity of rings 546 is less than or equal to the loose-leaf capacity of rings 546 for the range of spine rotation illustrated in FIGS. 7B-7F. Rings 546 rotate through a smaller angular range in FIGS. 7B-7D than rings 46 rotate in FIGS. 2B-2E. Cover 100 of FIGS. 7B-7F is preferably loaded and unloaded with loose-leaves when cover 100 is open 180 degrees and rings 546 are substantially upright.

FIG. 8

FIG. 8 is the bottom view of another preferred embodiment of a ring component 646 of the present invention. Rings 646 are very similar to rings 546 but have less straight ring segments and are partially circular.

Ring 646 comprises ring segments 646A-646B and the portion of spine 53 intersected by ring segments 646A-646B. Ring segment 646A has ring segments 646P-646Q and ring segment 646B has ring segments 646R-646S. Mostly circular ring segments 646P and 646R are joined to straight ring segments 646Q and 646S, respectively. Straight ring segments 646Q and 646S are parallel with lines X2 and Y2, respectively, and constitute a multiple-line perimeter segment.

Line X2 is a tangent line to spine 53 and ring segment 646R and line Y2 is a tangent line to spine 53 and ring segment 646P. When rings 646 are in their upright position, line X2 is horizontal and spine 53 is not beneath the centers of rings 646, but is biased to one side. During use, rings 646 rotate less because of this bias. Rings 646 are wider than tall to improve loose-leaf capacity of rings 646.

FIG. 9

FIG. 9 is the bottom view of another preferred embodiment of a ring component 746 of the present invention. Ring 746 comprises ring segments 746A-746B and the portion of spine 553 intersected by ring segments 746A-746B. Rings 746 are incorporated in binders 23-25 shown in FIGS. 3A-5B where the skeleton is fixed to the cover with a fastener or rivet. Rings 746 are wider than they are tall when in the upright position as shown in FIG. 9 to optimize loose-leaf capacity.

FIG. 10

FIG. 10 is the bottom view of another preferred embodiment of a ring component 846 of the present invention. Ring 846 is very similar to ring 546 except that spine 553 is incorporated in place of spine 53. Ring 846 comprises ring segments 846A-846B and the portion of spine 553 intersected by ring segments 846A-846B. Ring segments 846A and 846B closely correspond in shape and function to ring segments 546A and 546B of FIGS. 7A-7F. Rings 846 can be incorporated in binder 25 shown in FIGS. 5A-5B where the skeleton is fixed to back cover 1740D with a rivet.

The invention provides for a minimal footprint during use without sacrificing other popular advantages common to loose-leaf binders. The binder provides the minimal footprint capability with minimal tearing stress on the loose-leaves, a flat writing surface and the optional ability to simultaneously open or close all rings of the binder via an actuator.

While my above descriptions contain many specificities, these should not be construed as limitations on the scope of the invention, but rather as an exemplification of several preferred embodiments thereof. Many other variations are possible. For example, all binder embodiments with a SOCRA skeleton can instead use a skeleton having independently-openable rings. The cover embodiments with conduits that contain spine 53 can be joined with rings that are not connected by a spine; for example, skeleton 450 could be cut into three segments via cuts between its rings and then each segment placed end-to-end in conduit 56 as when they are unified. Other spineless embodiments are easily created from binders 13, 14 and 20 by eliminating skeleton 50 and inserting unconnected, independently-openable rings in place of rings 46 of these binders. Skeletons with more rings can be substituted by adding a corresponding number of slots to the binder cover. Skeletons with a synchronized switching element different from those disclosed herein may be substituted. Furthermore, a synchronized switching element that opens or closes all the rings simultaneously can be replaced by a sequential switching element that opens or closes all the rings sequentially. Margin supports can be eliminated especially when writing-support pads are included. Binder 1 can be modified by eliminating its middle cover segment and attaching a wider unsegmented flexible front cover directly to back cover 40 at the location of seam 66. Other variants comprise a skeleton with rings that can rotate relative to its spine's longitudinal dimension while a portion of its spine is held still. One such variant comprises a spine with a rectangular cross-section with a height equal to the thickness of its back cover and where the spine rigidly attaches along one edge of the back cover flush with the interior and exterior surfaces of the back cover to extend the back cover writing surface; the spine connects binder rings which can rotate about the spine's longitudinal dimension through slots in the spine. A second such variant can be made simply by placing spine 53 of skeleton 50 in a sleeve with slots corresponding to rings 46 that allow spine 53 to rotate relative to the sleeve; the sleeve which is part of this variant's spine can be rigidly riveted to a cover but still allow spine 53 contained therein and rings 46 to rotate relative to the cover. This use of a fixed sleeve may include the previous variant above where the sleeve is designed with a rectangular cross-section, and having spine 53 of skeleton 50 disposed within and rotatable relative to the rectangular sleeve while the sleeve is held still. Another variant, which lacks a distinct skeleton component, has a cover which is integrally formed with a synchronized switching element for simultaneously opening and closing its rings and which folds flat when open 360 degrees, and has rings that can rotate around a near-ring edge of the flatly-folded cover when the cover is open 360 degrees.

FIGS. 11A-11B

Figure 11A:
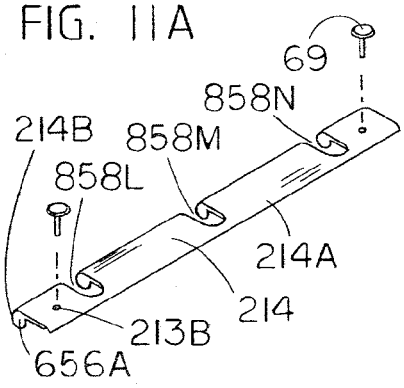
FIG. 11A is a perspective view of another preferred embodiment of a conduit casing for use with the binder.
Figure 11B:
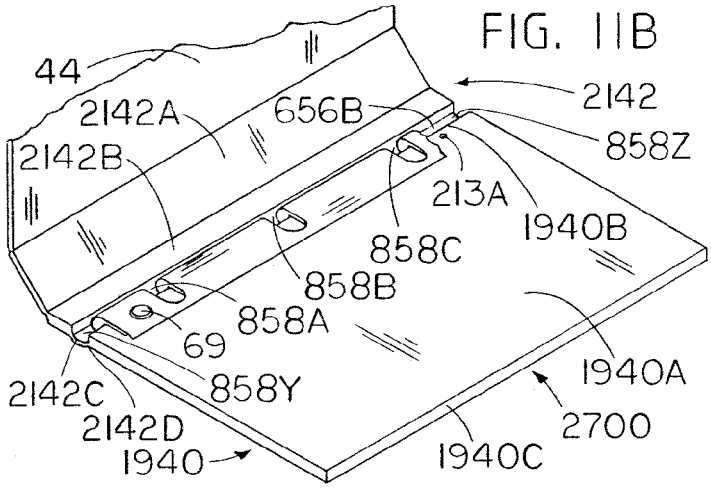
FIG. 11B is a perspective view of another preferred embodiment of a cover for use with the binder incorporating the conduit casing of FIG. 11A.

FIGS. 11A-11B show perspective views of a further preferred embodiment of a cover 2700 and its components of the binder of the present invention. Cover 2700, which is a slight variant of cover 100 of the binder 1 of FIGS. 1A-1H, offers a simplified means of binder assembly relative to cover 100. Cover 2700 comprises front cover 44, middle cover 2142, and back cover 1940. Middle cover 2142 has middle cover portions 2142A-2142C. Back cover 1940 has back cover portion 1940A and separable conduit casing 214. Middle cover portion 2142C is disposed between middle cover portion 2142B and back cover portion 1940A and is thinner than each to form open-groove conduit 656B. Conduit casing 214 facilitates easy assembly and can be made from various materials including metal, cardboard, and plastic. Conduit casing 214 has a roughly P-shaped cross-section with a substantially planar portion 214A and a tubular portion 214B. Planar portion 214A is affixed upon interior surface of back cover portion 1940A while part of tubular portion 214B dips into open-groove conduit 656B so that conduit casing 214 remains fairly planar with back cover portion 1940A upon assembly. Tubular portion 214B of conduit casing 214 defines conduit 656A. Back cover portion 1940A has holes 213A and conduit casing 214 has holes 213B which are aligned during assembly to receive rivets 69, which affix conduit casing 214 onto back cover portion 1940A. Conduit casing 214 has slots 858L-858N. Edge 1940B of back cover portion 1940A is straight, but the mounting of conduit casing 214 upon back cover portion 1940A furnishes back cover 1940 with slots 858A-858C and end slots 858Y-858Z. Middle cover portion 2142C has fold 2142D to enable front cover 44 and middle cover 2142 to flip open flatly up against back cover 1940. Preferably, fold 2142D is disposed at or adjacent to edge 1940B of back cover portion 1940A. Similar to cover 100 of FIGS. 1A-1F, middle cover 2142 joins back cover 1940 between conduit 656A and far parallel edge 1940C. With little or no modification, cover 2700 can also incorporate skeletons 50 and 450 of FIGS. 1G and 6A, respectively, of the binder of the present invention as well as other skeletons with independently openable rings disclosed herein. Cover 2700 operates essentially the same as cover 100 of FIGS. 1A-1F during usage.

FIGS. 12A-12E

FIGS. 12A-12E show perspective and bottom views of another preferred embodiment of a binder 29X of the present invention. The binder 29X is designed to be inexpensive and extra thin when closed, especially suitable as a report binder. The binder 29X comprises cover 2900 and skeleton 1550. Cover 2900 comprises back cover 2140, middle cover 2242, and front cover 1344 and is preferably made from cardboard or plastic sheet to reduce cost. Skeleton 1550 is an inexpensive single piece of molded PVC plastic. Skeleton 1550 has spine 1153 and rings 1346. Rings 1346 have ring segments 1346A-1346B, which are attached to spine 1153. Ring segments 1346A have ring slots 148 and ring segments 1346B have tabs 147. Tabs 147 snugly snap into corresponding reciprocal ring slots 148 forming interlocking closure or snap interlocks 208 to securely close rings 1346. Each ring 1346 is opened simply by forcefully pulling rings segments 1346A and 1346B apart to disengage interlocks 208. Ring segments 1346A-1346B are U-shaped members each with a square groove along its inside curvature such that ring segments 1346A-1346B also have roughly U-shaped cross-sections, which impart strength to rings 1346 in a similar manner to the purposeful shape of I-beam girders. Importantly, because of the flexible PVC plastic of skeleton 1550, rings 1346 are opened and closed individually, not concurrently, since spine 1153 twists easily and thus transfers torque ineffectively. Rings 1346 have an oblong oval or elliptical shape when closed. The size of ring 1346 affects the thickness of binder 29X when closed as evident in FIG. 12B. Likewise, the size and shape of rings 1346 largely depend upon hole-edge margin 117 of target loose-leaves 72 for use with the binder 29X. Hole-edge margin 117 of target loose-leaf 72 is the shortest distance between the punched holes and the nearest edge of target loose-leaf 72. For example, for U.S. binders targeted to hold 3-hole letter-size loose-leaves 72, the industry standard hole-edge margin 117 is one-quarter inch and for European binders targeted to hold 2-hole or 4-hole A-4 size loose-leaves 72, the industry standard hole-edge margin 117 is 8 mm. As shown in FIG. 12D, the major inner diameter of rings 1346 (along the major axis of the elliptical shape of ring 1346) is greater than twice hole-edge margin 117 of target loose-leaves 72, but the minor inner diameter of rings 1346 (along the minor axis of the elliptical shape of ring 1346) is less than twice hole-edge margin 117 but greater than 1 times hole-edge margin 117 of target loose-leaves 72. The significance of these dimensions relate directly to the ease of page turning when the binder 29X is open 180 degrees as is implied in FIG. 12D and to the resulting thickness of cover 2900 when closed about rings 1346 as indicated in FIG. 12B. The minimum closed-cover thickness of the binder 29X is limited by the smallest minor inner diameter of rings 1346 that still enables satisfactory page turning. FIG. 12D and these mathematical inequalities suggest dimensional limits of ring 1346 for satisfactory page turning in relation to hole-edge margin 117 of loose-leaves 72. Related to these inequalities and experience, preferred rings for extra-thin covers have a ratio of major diameter to minor diameter in the range of 1.75-2.25. FIG. 12E shows skeleton 1550 as initially molded. When the binder 29X is assembled, middle cover 2242 and back cover 2140 share conduit casing 414, which is made of a sheet of flexible foldable material. Back cover 2140 has back cover portion 2140A and a portion of conduit casing 414 upon assembly. Conduit casing 414 has adhesive attachment strips 216A to affix conduit casing 414 to its complementary or remaining bulk portion of cover 2900 upon assembly. Optionally, if the binder 29X is to be user-assembled, an adhesive strip 216A on one side of conduit 856 will have a corresponding stick-resistant shield like peel-off ribbon 316B of FIG. 13A to become an adhesive closure strip to enable the user to seal close conduit casing 414 about spine 1153. Back cover 2140 has optional pocket 2140P. Conduit casing 414 has pocket-spanning gap 118 to allow a broader opening to back cover pocket 2140P. Upon assembly, cover 2900 defines conduit 856 where spine 1153 of skeleton 1550 is rotatably disposed. Conduit casing 414 has slots 1058A-1058C to accommodate rings 1346. Cover folds 2242A and 2140B border conduit 856. Two very close roughly 90-degree folds 2242A and 2140B add up to one 180-degree cover fold or edge 2242B when cover 2900 is folded open 360 degrees as exemplified in FIG. 12C. Folds 2242A and 2140B along with the limited rotation of spine 1153 within conduit 856 enable rings 1346 to rotate about edge fold 2140B of planar back cover portion 2140A as shown in FIGS. 12B-12C.

FIGS. 13A-13B

FIGS. 13A-13B show bottom views of another preferred embodiment of a binder 30X of the present invention. The binder 30X comprises cover 3000 and skeleton 1550. Consistent with the binder 29X of FIG. 12A-12E, skeleton 1550 is again preferred because the binder 30X is also designed to have an extra thin closed cover thickness popular for report binders. Cover 3000, which is a slight variant of cover 100 of the binder 1 of FIGS. 1A-1H, offers a simplified means of binder assembly relative to cover 100 and is preferably made from one sheet of cardboard or similar material to reduce cost. Cover 3000 comprises front cover 1344, middle cover 2342, and back cover 2240. Middle cover 2342 joins back cover 2240 at fold 2240B. Back cover 2240 has back cover portion 2240A and conduit casing 514. Back cover portion 2240A comprises two planar bonded layers of the one sheet via permanent fold 2240C. Conduit casing 514 is integrally formed with and extends from the inner layer of back cover portion 2240A. A planar portion of conduit casing 514 has adhesive closure strip 316A and optional stick-resistant peel-off ribbon 316B. Conduit casing 514 and adhesive closure strip 316A make up another instant user-sealed wrap-flap closure. Conduit casing 514 has the shape of an acute spiral triangle, which enables back cover 2240 to have a fairly smooth writing surface for loose-leaves 72 as shown in FIG. 13B. Upon assembly, a wrapping portion of conduit casing 514 defines conduit 956, where spine 1153 of skeleton 1550 is rotatably disposed. Additionally, with little or no modification, skeleton 50 of FIG. 1G and others disclosed herein can be substituted for skeleton 1550.

FIGS. 14A-14B

FIGS. 14A-14B show bottom views of another preferred embodiment of a binder 31X of the present invention. The binder 31X comprises cover 3100 and skeleton 1550. Like binder 29X of FIG. 12A-12E, the binder 31X employs skeleton 1550 to facilitate its extra thin closed cover thickness popular for report binders. Cover 3100, which is a slight variant of cover 100 of the binder 1 of FIGS. 1A-1H, offers a simplified means of binder assembly relative to cover 100 and is preferably made from thin sheet material to reduce cost. Cover 3100 comprises front cover 1444, middle cover 2442, and back cover 2340. Front cover 1444 has transparent portion 1444A attached to opaque portion 1444B via staples 168. Middle cover 2442 joins back cover 2340 at fold 2340B. Back cover 2340 has back cover portion 2340A and conduit casing 614. Conduit casing 614 is integrally formed with back cover portion 2340A to provide the planar interior surface of back cover 2340. A planar portion of conduit casing 614 has adhesive closure strip 416A and optional stick-resistant peel-off ribbon 416B. Conduit casing 614 and adhesive closure strip 416A make up another instant user-sealed wrap-flap closure. Upon assembly, a wrapping portion of conduit casing 614 defines conduit 1056, where spine 1153 of skeleton 1550 is rotatably disposed. Additionally, with little or no modification, skeleton 50 of FIG. 1G and others disclosed herein can be substituted for skeleton 1550.

FIGS. 15A-15B

FIGS. 15A-15B show perspective views of another preferred embodiment of a binder 32X of the present invention and a sample pocketed folder for its attachment. The binder 32X comprises cover 3200 and skeleton 1550. Cover 3200 is a slight variant of cover 600 of the binder 6 of FIGS. 6A-6B. Cover 3200 comprises back cover 2440, folder-attachment flaps 178A, and pocket-spanning gap 218. Back cover 2440 defines conduit 1156 where spine 1153 of skeleton 1550 is rotatably disposed. Back cover 2440 has slots 1158A-1158C to accommodate rings 1346. Folder attachment flaps 178A have adhesive attachment strips 516A and corresponding stick-resistant peel-off ribbons 516B, which provide an easy means of attaching the binder 32X to folders, especially a pocket-enhanced folder 3200F such as shown in FIG. 15B. Folder 3200F has pocket 3200P and recommended attachment areas 178B for attachment by flaps 178A. Pocket-spanning gap 218 provides a broader opening to folder pocket 3200P. Cover 3200 is also a wide universally attachable conduit casing 714, which along with its skeleton 1550 can transform user-selected complementary cover portions such as assorted folders or singular planar sheet by its mere attachment into a binder without the need of a specialized corresponding reciprocal attachment element such as for a hooks and loops fastener or rivet 69 and hole 213A attachment of FIG. 11A-11B. Given their functional convenience, flaps 178A plus adhesive strips 516A make up an instant user-affixed adhesive attachment. Additionally, with little or no modification to cover 3200, skeleton 50 of FIG. 1G and others disclosed herein can be substituted for skeleton 1550.

FIGS. 16A-16E

FIGS. 16A-16E show perspective and bottom views of another preferred embodiment of a binder 33X of the present invention with both essential and optional components. The binder 33X comprises cover 3300 and skeleton 1650. Skeleton 1650 has oblong reversibly compressible rings 1446 threaded by singular rod spine 1253. Each ring 1446 is a single piece of plastic. Rings 1446 are oval and largely reversibly deformable under typical vertical compressive forces exerted on rings 1446 and binder 33X during use. An example of such compressive force might be found if binder 33X is crammed into a crowded briefcase or bookshelf. However, depending upon the precise construction and material properties of ring 1446, much if not most of the reversible deformation of rings 1446 may occur simply by closing the cover 3300 which can act like a nutcracker to compress rings 1446. As exemplified by FIGS. 16C-16D, the vertical reversible deformation of rings 1446 facilitates the design of ultra thin, closed cover 3300 that is even thinner than extra thin closed cover 2900 with rings 1346 of FIGS. 12A-12E. Comparing rigid rings 1346 of skeleton 1550 of FIGS. 12B and 13B with reversibly compressible rings 1446 of skeleton 1650 of FIGS. 16C-16D indicates that compressible rings 1446 provide improved page turning via the additional clearance afforded compressible rings 1446 for a particular closed cover thickness, especially when loose-leaves 72 are concurrently located above and below respective back covers. Preferably, the maximum reversible deformation or maximum reversible compressibility of ring 1446 in the direction of its minor diameter is in a range of 15%-50%. Like oblong ring 1346 of FIG. 12D, the major inner diameter of oblong ring 1446 is greater than twice hole-edge margin 117 of target loose-leaves 72, but the minor inner diameter of ring 1446 under substantial reversible deformation as shown in FIG. 16C is less than twice hole-edge margin 117 and the minor inner diameter of ring 1446 when freely expanded as shown in FIG. 16D is greater than 1 times hole-edge margin 117. Two different minor inner diameters are used in these mathematical inequalities because the minimum thickness of the closed binder 33X is achieved when closed cover 3300 and rings 1446 are compressed, but pages of binder 33X are turned when cover 3300 is open and rings 1446 are freely expanded. The minor inner diameter under reversible deformation is compared to be less than twice hole-edge margin 117 because this condition is related to the objective of constructing a thin cover and distinguishes ring 1446 from conventional circular rings, but the minor inner diameter of the freely expanded ring is compared to be greater than one times hole-edge margin 117 because this condition is related to satisfactory page turning. Accordingly, the reversibly deformable rings 1446 facilitate easy page turning implied in FIG. 16D and facilitate the construction of ultra thin cover 3300 as indicated by FIG. 16C. When upright as shown in FIGS. 16A-16B, rings 1446 have column-like roughly vertical thick ring portions 1446P-1446Q that taper to roughly horizontal thin bow-like ring portions 1446R-1446S to facilitate reversible deformation. The relatively thicker column-like vertical ring portions 1446P-1446Q resist permanent buckling under typical vertical compressive forces while the relatively horizontal thin bow-like ring portions 1446R-1446S easily flatten under these same vertical compressive forces and spring back upon their removal to provide the majority of the desired reversible deformation as shown in FIGS. 16C-16D. Ring 1446 has tab 247 and corresponding slot 248, which snap fit together forming interlock 308 to securely close ring 1446. Ring 1446 has neck 1446N adjacent tab 247. Neck 1446N can be lengthened to make interlock 308 into a telescopic linkage, which increases the range or extent of reversible deformation that ring 1446 can undergo. Interlock 308 is suitably located on vertical ring portion 1446Q where vertical compressive force tends to reinforce ring closure, but this location also enables horizontal portion 1446R to be thinner and more elastic than otherwise to facilitate reversible deformation. Ring 1446 has thread hole 157 for threading ring 1446 on rod spine 1253. Spine 1253 is a type of orthogonal base for ring 1446 to facilitate pivoting; alternatively, if spine 1253 is replaced by a wider orthogonal base with rivet holes, rings 1446 can be attached to a cover in a fixed conventional manner that prohibits pivoting but still facilitates the design of an ultra thin binder cover. In a preferred manufacturing method, rings 1446 are extruded as a plastic shaft with a roughly C-shaped cross-section, which is sliced into roughly C-shaped open rings whose two free ends are then punch-cut into opposing tabs 247 and slots 248. Cover 3300, which is a slight variant of cover 100 of the binder 1 of FIGS. 1A-1H, offers a simplified means of binder assembly relative to cover 100 and is preferably made from thin sheet material to reduce cost. Cover 3300 comprises front cover 1344, middle cover 2542, and back cover 2540. Middle cover 2542 borders edge-fold 2540B to enable front cover 1344 and middle cover 2542 to fold flatly open 360 degrees up against back cover 2540 as shown in FIG. 16D. Back cover 2540 has back cover portion 2540A and attached conduit casing 814. Conduit casing 814 has a roughly P-shaped cross-section and is preferably made of a fairly flexible material. Conduit casing 814 has tubular portion 814B, which defines conduit 1256 where spine 1253 of skeleton 1650 is rotatably disposed. Conduit casing 814 has slots 1258A-1258C to accommodate rings 1446. Additionally, with little modification to cover 3300 beyond increasing its closed cover thickness, skeleton 50 of FIG. 1G and others disclosed herein can be substituted for skeleton 1650. Notably, conduit casing 814 is attached to back cover portion 2540A near edge 814A, which enables the opposite free tubular portion 814B to be lifted by middle cover 2542 when cover 3300 is closed as shown in FIG. 16C and which enables tubular portion 814B to dangle or droop around edge-fold 2540B when cover 3300 is folded open 360 degrees in a flat formation as shown in FIG. 16D. Tubular portion 814B becomes substantially flush with back cover 2540 and middle cover 2542 of the flat formation of cover 3300 shown in FIG. 16D. Conduit casing 814 is attached to back cover portion 2540A via optional adhesive attachment strip 616A. Conduit casing 814 is preferably attached to back cover portion 2540A via plastic weld or fusing when using plastic or adhesive when using other materials. By incorporating a instant user-affixed attachment such as adhesive attachment strips 616A coordinated with corresponding stick-resistant peel-off ribbons 516B of FIG. 15A, conduit casing 814 can also be produced for sale as a standalone product for subsequent attachment by users to folders 3200F of FIG. 15B. A instant user-affixed attachment is alternatively aptly called an assembly-deferred after-sale attachment. Deferring assembly provides users with coveted consumer choice, allowing users to select the complementary cover portion to which conduit casing 814 and rings 1446 are to be attached. Conduit casing 814 has optional pocket-spanning gap 318 for use with pocket-enhanced folders 3200F of FIG. 15B. The binder 33X operates similar to the binder 1 of FIGS. 1A-1H, but its rings 1446 are opened and closed individually and its ultra thin closed cover 3300 uses less space during packing, storage, and transport.

FIG. 16E shows another preferred embodiment of a conduit casing 914, attached to back cover portion 2540A, for use with cover 3300 and other covers disclosed herein. Conduit casing 914 is made of a resilient semi-rigid material. Conduit casing 914 defines conduit 1356 and has longitudinal opening or aperture 204 with which to receive spine 1253 and other spines disclosed herein. Conduit 1356 receives spine 1253 via snap-insert action where aperture 204 temporarily expands during forced insertion of spine 1253. Conduit casing 914 and resiliently expandable aperture 204 make up a resilient snap-in clasp closure, which is also another type of instant pivot fastening. After insertion, the semi-rigid conduit casing 914 is firm enough to retain and support spine 1253 during normal usage. Conduit casing portion 914B is reduced in thickness for increased flexibility to act like a hinge between the majority of conduit casing 914 and back cover 2540 to enable spine insertion and to function similar to conduit casing 814 as shown in FIGS. 16C-16D.

FIGS. 17A-17K

FIGS. 17A-17K show perspective and bottom views of another preferred embodiment of a binder 34X of the present invention with both essential and optional components. The binder 34X comprises cover 3400 and the skeleton 1750. Consistent with the binder 33X of FIG. 16A-16D, the binder 34X employs a skeleton 1750 having reversibly compressible rings 1546 to facilitate the ultra thin closed cover thickness of the binder 34X popular for report binders. Cover 3400 is a slight variant of ultra thin cover 3300 of FIGS. 16A-16D. Like cover 3300, cover 3400 comprises the same back cover 2540, but includes different middle cover 2642 and front cover 1544. Middle cover 2642 and front cover 1544 join at primary cover fold 1544A and are bowed about rings 1546 of skeleton 1750 when cover 3400 is closed as in FIG. 17A in an aesthetically pleasing streamline contour. Also, like cover 3300, middle cover 2642 joins back cover 2540 at edge-fold 2540B. Notably, tubular portion 814B of conduit casing 814 is lifted by middle cover 2642 when cover 3400 is closed as shown in FIG. 17A and dangles or droops around edge-fold 2540B when cover 3400 is folded open 360 degrees in a flat formation as shown in FIG. 17D. Tubular portion 814B becomes substantially flush with back cover 2540 and middle cover 2642 of the flat formation of cover 3400. Spine 1353 of skeleton 1750 is rotatably disposed in conduit casing 814 of back cover 2540 as a pivot about which cover 3400 is rotatable.

FIG. 17B shows a perspective view of optional ring-crush resister 119 for use with cover 3400. FIGS. 17C-17D show bottom views of cover 3401. Cover 3401 comprises cover 3400 plus ring-crush resister 119. Ring-crush resister 119 has four sections divided by three parallel hinge-like folds. Two sections of ring-crush resister 119 are attachment flaps 119A-119B and the other two sections are ring-crush resister portions 119C-119D. Attachment flaps 119A and 119B are attached to front cover 1544 and middle cover 2642, respectively, preferably via plastic weld or adhesive to form tetragonal tube 119T. Although tetragonal tube 119T has roughly a tetragon cross-section, two sides of tube 119T are tensilely straightened when cover 3401 is closed under sufficient vertical compressive force such that tube 119T supports cover 3401 in the manner of a triangular truss as shown in FIG. 17C to oppose excessive deformation of rings 1546. These two straightened sides are ring-crush resister portion 119C and the portion of front cover 1544 that coincides with a portion of tetragonal tube 119T. When tube 119T assumes its roughly triangular shape of FIG. 17C, it shares loading of compressive force exerted on cover 3401 with rings 1546. Tube 119T serves to prevent or inhibit permanent deformation of rings 1546 that may result from excessive compressive force exerted on closed cover 3401 roughly in the direction of the minor axis of rings 1546. Permanent deformation may include creases in rings 1546 which degrade the page-turning suitability of rings 1546. Note, ring-crush resister portion 119D is appropriately thick and rigid whereas ring-crush resister portion 119C can be thinner and more flexible because ring-crush resister portion 119D is under compression and ring-crush resister portion 119C is under tension when sufficient compressive force is exerted on closed cover 3401 roughly in the direction of the minor axis of rings 1546. When cover 3400 is open 180 degrees or 360 degrees, tetragonal tube 119T folds flatly as shown in FIG. 17D to enable loose-leaves 72 to lie fairly flatly against front cover 1544 and middle cover 2642. Ring-crush resister 119 has slots 1358T-1358V to accommodate rings 1546 when tube 119T is erect as when cover 3401 is closed. Slots 1358T-1358V are preferably funnel-shaped to guide rings 1546 into slots 1358T-1358V as cover 3401 is closed. Preferably, slots 1358T-1358V fit snugly about rings 1546 to inhibit the pitch lean or tilt of rings 1546 towards the longitudinal axis of spine 1353 when compressive force is exerted on rings 1546 in the direction of the minor axis of rings 1546.

FIG. 17E shows a bottom views of optional tubular ring-crush resister 219 for use with cover 3400. FIG. 17F shows a bottom view of cover 3402. Cover 3402 comprises cover 3400 plus tubular ring-crush resister 219. Tubular ring-crush resister 219 has adhesive attachment strip 219A spread across fold 219B. Ring-crush resister 219 is adhesively attached to cover 3400 such that fold 219B coincides with cover fold 1544A. Similar to tetragonal tube 119T of FIGS. 17C-17D, tubular ring-crush resister 219 has a roughly tetragonal cross-section, but two sides of ring-crush resister 219 are tensilely straightened, when closed cover 3402 is under sufficient compressive force, such that ring-crush resister 219 supports cover 3402 in the manner of a triangular truss as shown in FIG. 17F for the same functional reasons that tube 119T supports cover 3401 in FIG. 17C. Tubular ring-crush resister 219 has four side portions divided by four hinge-like folds and is made of a single sheet of material. Ring-crush resister portion 219D is made thicker and more rigid by overlapping and bonding several layers of the sheet of material together to better withstand compression during use. Ring-crush resister 219 has slots similar to slots 1358T-1358V of ring-crush resister 119. When cover 3402 is open 180 degrees or 360 degrees, ring-crush resister 219 is folded flat as shown in FIG. 17E similar to tube 119T of FIG. 17D.

FIG. 17G shows a bottom view of conduit casing 1014 in which skeleton 1750 is retained. Conduit casing 1014 is integrally formed with roof-like or arch ring-crush resister 319. FIGS. 17H-17I show bottom views of cover 3403 joined to skeleton 1750. Cover 3403 is similar to cover 3400 of FIG. 17A, but substitutes conduit casing 1014 in place of conduit casing 814. Cover 3403 comprises front cover 1544, middle cover 2642, back cover portion 2540A, and conduit casing 1014. Conduit casing 1014 is attached to back cover portion 2540A near hinge-like portion 1014A. Conduit casing 1014 defines conduit 1456 where spine 1353 of skeleton 1750 is rotatably disposed. Conduit casing 1014 has longitudinal opening 304 with which to receive spine 1353 during assembly. Conduit casing 1014 has spring arm 1014B, which lifts skeleton 1750 relative to arch ring-crush resister 319 as shown in FIG. 17G to provide extra page-turning clearance over arch ring-crush resister 319 when cover 3403 is open. When cover 3403 is closed under sufficient compressive force, cover 3403 compresses rings 1546, which in turn push spring arms 1014B down against middle cover 2642. When the height of any of the compressed rings 1546 as measured along their minor axes is the same as the height of arch ring-crush resister 319 as shown in FIG. 17H, arch ring-crush resister 319 shares loading of the compressive force with rings 1546 to prevent or inhibit permanent deformation of rings 1546. When cover 3403 is folded flatly open 360 degrees, hinge-like portion 1014A enables conduit casing 1014 to dangle or droop down around edge-fold 2540B where it is fairly flush with the flat formation of cover 3403. Middle cover 2642 lifts conduit casing 1014 upright when cover 3403 is closed.

FIG. 17J shows a bottom view of cover 3404. Cover 3404 comprises cover 3400 plus ring-crush resister 419. Ring-crush resister 419 includes ridges 419A-419B, which are attached to cover 3400 immediately adjacent fold 1544A. The close proximity of ridges 419A-419B to fold 1544A prevents fold 1544A from being sharp and narrow. The well-rounded fold 1544A limits very narrow closure of cover 3404 about rings 1546 when skeleton 1750 is added, which inhibits permanent deformation of rings 1546.

FIG. 17K shows a perspective view of another preferred embodiment of a skeleton 1750 of the binder of the present invention. Skeleton 1750 is a single piece of molded plastic. Skeleton 1750 has a thin cylindrical spine 1353, which attaches to each of a plurality of binder rings 1546. Rings 1546 comprise rings segments 1546A-1546B and the portion of spine 1353 they intersect. Notably, the cross-sectional diameter of spine 1353 is approximately equal to the prong thickness of ring segment 1546A where they intersect. Rings 1546 are shaped similar to rings 1446 of FIGS. 16A-16D for the same functional reasons described for rings 1446 related to compressibility and page-turning. Both have bow-like roughly horizontal thin portions and column-like roughly vertical thick portions when they are closed and upright. Rings 1546 have tabs 147 and slots 148, which snap fit together to form interlock 208. Additionally, rings 1546 have butterfly-shaped or bowtie-shaped flip-top hinge 120 which functions to enable rings 1546 to flip open similar to well-known plastic flip-top caps of plastic tubes and bottles popular for packaging cream, gel, and liquid products.

With little or no modification to cover 3400, skeleton 1650 of FIG. 16A and others disclosed herein can be substituted for skeleton 1750. The binder 34X operates similar to the binder 33X of FIGS. 16A-16D.

FIG. 18

FIG. 18 shows a perspective view of another preferred embodiment of a ring 2146 of the binder of the present invention positioned upright with its minor dimension or minor diameter oriented vertically. Oblong ring 2146 intersects fulcrum 122. A set of oblong rings 2146, each with an individual fulcrum acting as an axial portion for pivoting, is another type of pivot binding. Fulcrum 122 is also a type of orthogonal base. Oblong ring 2146 is has a roughly rectangular shape with a major diameter and a minor diameter comparable to corresponding diameters of ring 1346 of FIG. 12D for the same functional reasons. Ring 2146 incorporates elastic spiral closure 508. Ring 2146 is inexpensively made from flat sheet plastic of uniform thickness. As a typical use example, fulcrum 122 can be rotatably disposed in conduit 856 of cover 2900 of FIG. 12A or, alternatively, fulcrum 122 can be stapled along a fold of a cover in similar manner to the attachment of skeleton 550 to cover 2300 of FIGS. 3A-3E.

FIGS. 19A-19B

Figure 19A:
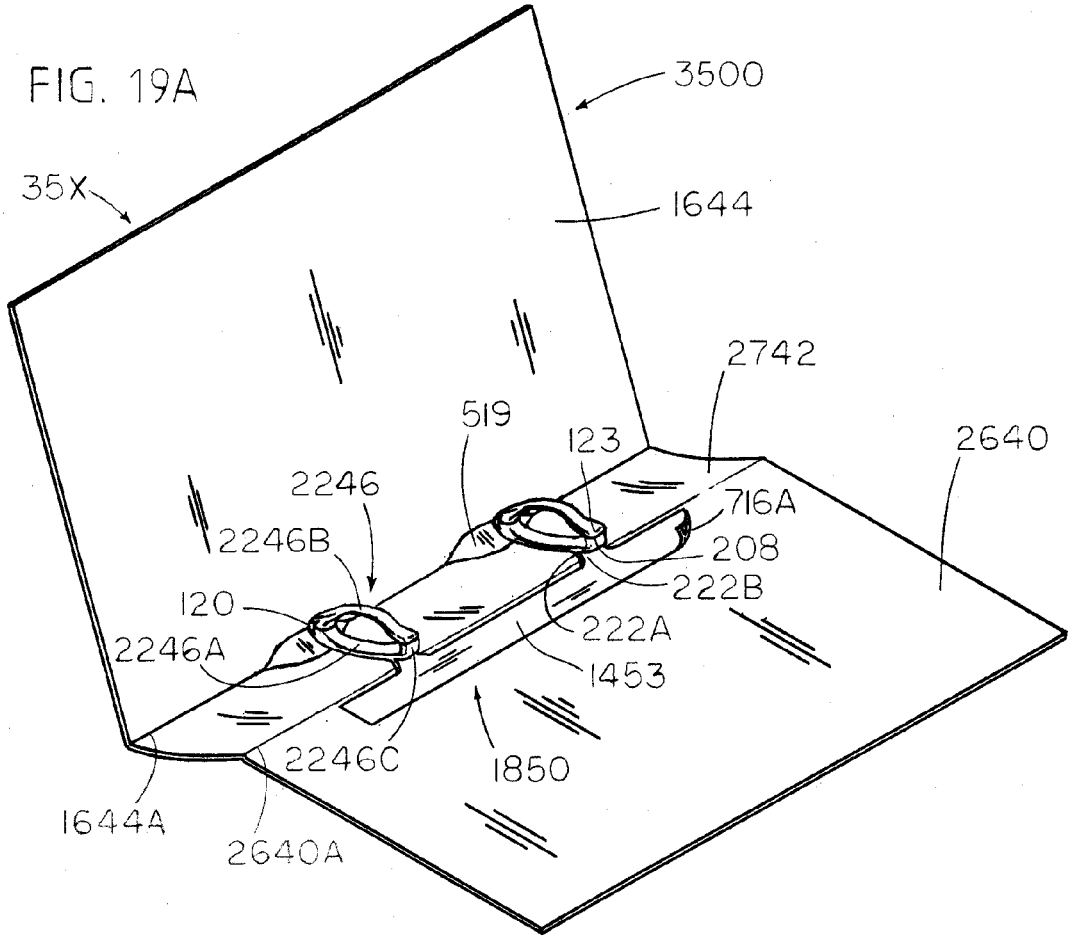
FIG. 19A is a perspective view of another preferred embodiment of a binder featuring an ultra thin aesthetically-pleasing streamline closed cover contour via compressible rings with both essential and optional components separately fused.

FIG. 19A shows a perspective view of another preferred embodiment of a binder 35X of the present invention with both essential and optional components. The binder 35X is a slight variation of the binder 34X, especially the version of binder 34X depicted in FIGS. 17G-17I in which the conduit casing 1014 is able to perform all the required pivot motion of rings 1546 about edge-fold 2540B whether or not spine 1353 is rotatable relative to conduit casing 1014 or fused rigidly to it. The binder of 35X represents an improvement over the binder of 34X by simply fusing separate parts to reduce manufacturing costs and to minimize the amount of material used while retaining the essential design of the ultra-thin cover 3400. This functionally similar binder is created by fusing a spine or a portion of a ring intersecting a spine with a conduit casing and using the flexibility of the conduit casing to provide a combination of cantilever pivot action and/or elastic hinge action as demonstrated by conduit casing 814 of FIG. 17A as well as conduit casing 1014 of FIGS. 17G-17I. Skeleton 1850 is an example of such fusing. The binder 35X comprises cover 3500 and the skeleton 1850. Like the binder 34X of FIG. 17A, the binder 35X employs a skeleton 1850 having reversibly compressible rings 2246 to facilitate the ultra thin closed cover thickness of the binder 35X popular for report binders. Skeleton 1850 is a single piece of molded plastic comprising flat spine 1453, elastic pivot 222, and rings 2246. Ring 2246 comprises ring segments 2246A-2246C, flip-top hinge 120, and tab-slot interlock 208. As shown in FIGS. 17I-17K, tab-slot interlock 208 comprises tab 147 and slot 148; tab 147 is inserted flush within slot 148 so as not to substantially protrude beyond the perimeter of ring 2246 to avoid obstructing ring-bound loose-leaves from sliding along the ring perimeter. Spine 1453 is a flat orthogonal base to which each ring 2246 is attached by an elastic pivot 222. Elastic pivot 222 comprises elastic hinge 222A and fulcrum 222B. Fulcrum 222B contributes to the rotation of rings 2246 about edge-fold 2640 via cantilever bending. Notably, fulcrum 222B is joined to the bottom ring segment 2246A via elastic-hinge 222A near the side of ring 2246 that is adjacent edge-fold 2640A. This side-biased attachment reduces the amount of rotation required of rings 2246 when some ring-bound loose-leaves are flipped 360 degrees about edge-fold 2640A. Pivot 222 is roughly axially disposed relative to opposite rotations of back cover 2640 and rings 2246. Binder 35X uses a different ring-cover attachment arrangement than binder 34X. Unlike skeleton 1750, which is rotatably attached to cover 3400, having spine 1353 rotatably disposed in conduit casing 814 as a pivot about which cover 3400 is rotatable as shown in FIG. 17A, skeleton 1850 is firmly affixed to cover 3500 by adhesive attachment strip 716A or alternative fastening means such as rivets or plastic weld as shown in FIG. 19A. Cover 3500 comprises back cover 2640, middle cover 2742, front cover 1644, and ring-crush resisters 519. Middle cover 2742 and front cover 1644 join at primary cover fold 1644A and are bowed about rings 2246 of skeleton 1850 when cover 3500 is closed in an aesthetically pleasing mostly streamline contour similar to cover 3400 shown in FIG. 17A. Ring-crush resisters 519 intersect primary fold 1644A; each ring-crush resister 519 is located adjacent to at least one of rings 2246 to oppose excessive deformation of rings 2246 by extreme compressive force potentially applied to cover 3500 while it is closed. Although the contour of closed cover 3500 is mostly streamline, the contour of a bottom sectional view of closed cover 3500 along a cut that bisects ring-crush resister 519 is similar to the contour of closed cover 3300 shown in FIG. 16C. Middle cover 2742 joins back cover 2640 at edge-fold 2640A under fulcrums 222B of skeleton 1850. Fulcrum 222B provides a cantilever bending action and elastic hinge 222A provides a hinge action that enables rings 2246 to tilt or pivot about edge-fold 2640A of cover 3500 in a similar manner as the pivoting of spine 1353 and drooping of tubular portion 814B of conduit casing 814 around edge-fold 2540B to enable rings 1546 to pivot about edge-fold 2540B of cover 3400 (This cantilever bending action and elastic hinge action is also imitated by conduit casing 1014 of FIGS. 17G-17I). Rings 2246 are lifted to their upright position by middle cover 2742 when cover 3500 rests closed on a horizontal surface.

Each ring crush resister 519 is formed by interrupting and splitting 180-degree primary fold 1644A into two separate 90-degree folds that surround a small area of cover 3500 and that then rejoin together again to continue primary fold 1644A. The small surrounded area is preferably formed as a streamline symmetrical shape such as an elongated oval or rounded-corner rhombus for aesthetic reasons. When cover 3500 is closed, the small areas of each ring-crush resister 519 are roughly perpendicular to front cover 1644 and middle cover 2742 and are physical obstacles that prevent the adjacent interior surfaces of front cover 1644 from contacting the adjacent interior surfaces of middle cover 2742 and thus help to oppose excessive deformation of adjacent rings 2246 by cover 3500 if cover 3500 is subjected to large compressive forces exerted in the direction of the minor axis of rings 2246.

The binder 35X operates similar to the binder 34X of FIGS. 17A-17K. Additionally, adhesive attachment strip 716A can be coordinated with peel-off ribbons to allow skeleton 1850 to be produced or further modified for sale as standalone products similar to those of FIGS. 15A and 16A for subsequent attachment by users to folders 3200F of FIG. 15B.

Figure 19B:
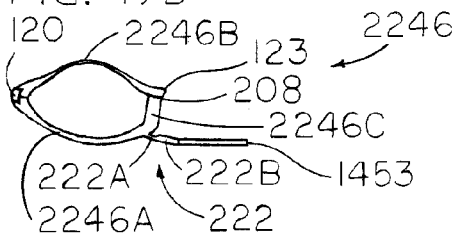
FIG. 19B is a bottom view of ring 2246 in FIG. 19A.

FIG. 19B shows a bottom view of ring 2246. Ring 2246 has protruding paper-catch ring-edge 123. Ring-edge 123 protrudes only slightly so as not to interfere with page turning, yet protrudes enough to hook or catch loose-leaves when cover 3500 is closed and binder 35X is dropped into a hanging file folder rings-side first. By catching loose-leaves, ring-edge 123 obstructs ring-bound loose-leaves from sliding between rings 2246 and front cover 1644, an event that thickens the closed cover 3500 causing it to take up more space in the hanging file folder. Additionally, side ring segment 2246C joins bottom ring segment 2246A at roughly a right angle, but preferably at a slightly obtuse angle so as to bias or slant ring-bound loose-leaves toward spine 1453 when cover 3500 is closed and is dropped into a hanging file folder rings-side first. Thus ring-edge 123 and the slant of ring segment 2246C contribute to keeping binder 35X ultra-thin whether dropped into a hanging file folder rings first or rings last.

FIG. 20

Figure 20:
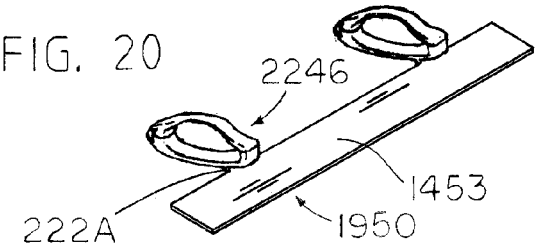
FIG. 20 is a perspective view of another preferred embodiment of a skeleton of the binder of the present invention with rings attached more closely to spine via elastic-hinge.

FIG. 20 shows a perspective view of another preferred embodiment of a skeleton 1950 of the present invention. Skeleton 1950 is very similar to Skeleton 1850 of FIGS. 19A-19B except rings 2246 are more closely attached to spine 1453 via elastic-hinge 222A.

FIGS. 21A-21B

Figure 21A:
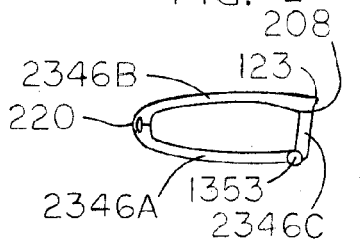
FIGS. 21A-21B are bottom views of another preferred embodiment of a ring of the binder of the present invention.
Figure 21B:
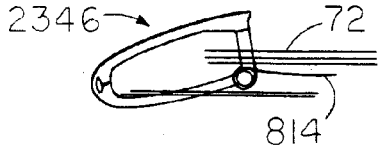

FIGS. 21A-21B show bottom views of another preferred embodiment of a ring 2346 of the binder of the present invention. FIG. 21A shows ring 2346 positioned upright with its minor dimension or minor diameter oriented vertically and its corresponding perpendicular major dimension oriented horizontally. Oblong ring 2346 has a roughly bullet shape and comprises ring segments 2346A-2346C. Ring 2346 intersects spine 1353, has strip hinge 220, and is securely closed by tab-slot interlock 208. Ring segments 2346A and 2346C are pulled apart to elastically open ring 2346 within the same geometric plane that ring 2346 occupied when closed. Preferably, spine 1353 is fused with a plurality of oblong rings 2346 as a single piece of molded plastic. Notably, pivot spine 1353 intersects bottom ring segment 2346A near side ring segment 2346C similar to how fulcrum 222B is attached to the bottom ring segment 2246A near the side ring segment 2246C in FIG. 19B. This side-biased attachment reduces the amount of rotation required of rings 2346 when some ring-bound loose-leaves 72 are flipped 360 degrees from one side of conduit casing 814 to the other as shown in FIG. 21B. Notably, rings 2346 need only rotate a small amount to accommodate loose-leaves positioned below conduit casing 814 as compared to the rotation of rings 1346 of binder 29X as suggested in FIGS. 12B-12C. Ring 2346 has slightly protruding ring-edge 123 and ring side segment 2346C is attached to bottom ring segment 2346A preferably at a slight obtuse angle for the same reasons as described for ring 2246 of FIGS. 19A-19B.

While my above descriptions contain many specificities, these should not be construed as limitations on the scope of the invention, but rather as an exemplification of several preferred embodiments thereof. Many other variations are possible. For example, reversibly compressible rings can be attached to wide fixed-attachment spines and still facilitate the design of ultra thin covers. Likewise, specific ring-crush resisters disclosed herein can be incorporated in ultra thin covers of binders with fixed-attachment spines.

Another preferred embodiment fuses flat spine 1453 of FIGS. 19A-19B into back cover 2640 via plastic molding with fulcrum 222B extending from back cover 2640 over edge-fold 2640A and separate from middle cover 2742.

It will be appreciated by persons skilled in the art that herein described is a loose-leaf binder and analogous products and method of use. While the present invention has been described by reference to various preferred embodiments, it will be understood by persons skilled in the art that many modifications and variations may be made in those preferred embodiments without departing from the spirit and scope of the present invention. Accordingly, it is intended that the invention not be limited to the disclosed preferred embodiments and that it have the full scope permitted by the following claims.

I claim:

1. A loose-leaf binder comprising:

a cover having a front cover and a back cover;

a plurality of oblong binder rings that are each closable from an open position via an interlock closure;

a connective element having at least one pivot means for pivoting said oblong binder rings about a main axis of rotation;

said connective element joining together and aligning said oblong binder rings along said main axis of rotation, at least one of said oblong binder rings elastically closable from an open position while continually remaining within a single geometric plane, each of said oblong binder rings has a major diameter and a minor diameter, said main axis of rotation is perpendicular to each of said oblong binder rings and is located adjacent one side of each of said oblong binder rings as divided by said minor diameter, said minor diameter defining an upright ring position when said minor diameter is substantially vertical and said main axis of rotation is located below said major diameter, said major diameter being substantially parallel to said front cover and said back cover when said cover is closed, said pivot means perpendicularly joining said connective element to at least a ring one of said oblong binder rings adjacent one side of a bottom portion thereof enabling said ring one to stand upright when said pivot means is horizontal, said cover enwraps and shields most of the perimeter of each of said oblong binder rings when said cover is closed such that each of 270 rays emanating from the center of a first ring of said oblong binder rings and spaced at consecutive 1-degree angular increments and intersecting the perimeter of said first ring subsequently intersects said cover when said cover is closed, said cover is folded in a substantially flat formation with a near-ring edge adjacent said oblong binder rings when said cover is open 360 degrees, a portion of each of said oblong binder rings rotatable about said near-ring edge, said main axis of rotation is roughly axially disposed relative to opposing rotations of said cover and said ring one while said ring one remains closed, said connective element affixed flush with or flatly to said flat formation of said cover to provide a sufficiently smooth surface for writing on any ring-bound loose-leaves stacked thereon, and said connective element remaining flush or flat relative to said flat formation when said portion of each of said oblong binder rings rotate about said near-ring edge, whereby arrangement of said pivot means with said oblong binder rings facilitates limited rotational attachment of said oblong binder rings to said cover, enables said cover to be extra thin when closed thus saving storage space, enables nimble page-turning of ring-bound loose-leaves when said cover is open 180 degrees, and reduces the amount of necessary rotation of said oblong binder rings when ring-bound loose-leaves are stack substantially flat above and below said pivot means when said cover is open 360 degrees.

2. The binder of claim 1 wherein said pivot means comprises an elastic pivot and a flat orthogonal base; said elastic pivot disposed between said flat orthogonal base and said ring one, said flat orthogonal base disposed adjacent said near-ring edge of said cover.

3. The binder of claim 1 wherein said cover has a conduit, said pivot means comprises a spine and said conduit, said spine is rotatably disposed in said conduit as a pivot about which said cover is rotatable, said conduit is disposed adjacent to said near-ring edge.

4. The binder of claim 1 wherein said pivot means comprises an elastic pivot, and wherein said cover, said connective element, and said plurality of oblong rings are formed of a single piece of molded plastic such that said connective element is fused with said cover and said plurality of oblong rings extending from said cover via at least one said elastic pivot.

5. The binder of claim 1 wherein at least one of said oblong binder rings has a protruding paper-catch ring-edge.

6. The binder of claim 1 wherein at least one of said oblong binder rings has a flip-top hinge.

7. The binder of claim 1 wherein each of said oblong binder rings has roughly-vertical column-like stiff portions when situated in said upright ring position;

each of said oblong binder rings has a roughly-horizontal bow-like flexible upper portion when situated in said upright ring position;

each of said oblong binder rings has a roughly-horizontal lower portion when situated in said upright ring position;

each of said oblong binder rings is reversibly compressible relative to a moderate compressive force roughly exerted in the direction of said minor diameter such that said column-like stiff portions resist permanent buckling while said bow-like flexible upper portions more readily flatten and widen outward to provide much of desired reversible vertical compressibility, each of said oblong binder rings springs back to resume a relaxed expanded form upon removal of said moderate compressive force.

8. A binder for releasably binding a plurality of loose-leaves comprising:

a cover comprising a back cover, a middle cover, and a front cover;

a plurality of oblong binder rings that are each elastically closable from an open position via an interlock closure;

at least one elastic pivot;

at least one flat orthogonal base;

each of said oblong binder rings has a major diameter and a minor diameter, said minor diameter defining an upright ring position when said minor diameter is substantially vertical, said major diameter being substantially parallel to said front cover and said back cover when said cover is closed, said cover has an inner surface and outer surface when closed, said flat orthogonal base affixed flatly to said inner surface of said cover, said flat orthogonal base attached to at least a ring one of said oblong binder rings via said elastic pivot enabling said ring one to stand upright when said flat orthogonal base is horizontal, said middle cover joins said back cover to said front cover, said back cover separated from said middle cover by an edge-fold, said flat orthogonal base and said ring one straddle said edge-fold, said middle cover supporting said ring one when said middle cover is extended flatly away from said back cover on a flat surface, said cover enwraps and shields most of the perimeter of each of said oblong binder rings when said cover is closed such that each of 270 rays emanating from the center of a first ring of said oblong binder rings and spaced at consecutive 1-degree angular increments and intersecting the perimeter of said first ring subsequently intersects said cover when said cover is closed, said cover is folded in a flat formation with said edge-fold adjacent said oblong binder rings when said cover is open 360 degrees, a portion of each of said oblong binder rings rotatable about said edge-fold when said cover is open 360 degrees.

9. The binder of claim 8 wherein said back cover, said middle cover, and said front cover are made of the same material.

10. The binder of claim 8 wherein said flat orthogonal base, said elastic pivot and said plurality of oblong binder rings are together a single piece of molded plastic.

11. The binder of claim 8 wherein at least one of said oblong binder rings has a protruding paper-catch ring-edge.

12. A loose-leaf binder comprising:

a plurality of binder rings;

a cover comprising a front cover, a back cover, a primary fold, and at least one fold-intersecting ring-crush resister;

said primary fold located between said front cover and said back cover when said cover is extended flatly open 180 degrees, said primary fold dividing into two folds that border opposite sides of an area of said cover to define said fold-intersecting ring-crush resister, said fold-intersecting ring crush resister disposed adjacent to at least a ring one of said binder rings, said fold-intersecting ring-crush resister is roughly perpendicular to said front cover and said back cover when said cover is folded closed along said primary fold, whereby said fold-intersecting ring-crush resister acts as a physical obstacle to oppose excessive deformation of adjacent said ring one caused by large compressive forces exerted on exterior surfaces of said cover when said cover is closed.

13. The binder of claim 12 wherein each of said binder rings has an oblong perimeter having a major diameter and a minor diameter, said primary cover fold comprises a pair of very close folds effectively acting as one fold, distance between said pair of very close folds less than half of said minor diameter, maximum distance between said two folds that border opposite sides of said area of said cover greater than half of said minor diameter.

14. The binder of claim 12 wherein each of said binder rings is an oblong binder ring having a major diameter and a minor diameter, said minor diameter defining an upright ring position when said minor diameter is substantially vertical, each of said binder rings has roughly-vertical column-like stiff portions when situated in said upright ring position;

each of said binder rings has a roughly-horizontal bow-like flexible upper portion when situated in said upright ring position;

each of said binder rings has a roughly-horizontal lower portion when situated in said upright ring position;

each of said binder rings is reversibly compressible relative to a moderate compressive force roughly exerted in the direction of said minor diameter such that said column-like stiff portions resist permanent buckling while said bow-like flexible upper portions more readily flatten and widen outward to provide much of desired reversible vertical compressibility, each of said binder rings springs back to resume a relaxed expanded form upon removal of said moderate compressive force.

15. The binder of claim 12 further comprising:

at least one elastic pivot;

at least one flat orthogonal base;

each of said binder rings has an oblong perimeter having a major diameter and a minor diameter, said minor diameter defining an upright ring position when said minor diameter is substantially vertical, said cover has an inner surface and outer surface when closed, said flat orthogonal base affixed flatly to said inner surface of said cover, said flat orthogonal base attached to at least a ring one of said binder rings via said elastic pivot enabling said ring one to stand upright when said flat orthogonal base is horizontal, said cover is folded in a flat formation with a near-ring edge adjacent said binder rings when said cover is open 360 degrees, a portion of each of said binder rings rotatable about said near-ring edge while said flat formation remains flat.

16. The binder of claim 12 further comprising:

at least one pivot;

said cover having a conduit, at least a ring one of said binder rings attached to said pivot, said pivot disposed in said conduit to rotatably attach said ring one to said cover, each of said binder rings has an oblong perimeter, said cover is foldable in a flat formation with a near-ring edge adjacent said binder rings when said cover is open 360 degrees, a portion of each of said binder rings rotatable about said near-ring edge while said flat formation remains flat.

17. A binder for releasably binding a plurality of loose-leaves comprising:

a skeleton having a spine and a plurality of oblong binder rings;

an instant user-affixed adhesive attachment for attaching said spine to a surface;

said skeleton is a single piece of molded plastic, each of said oblong binder rings has an interlock closure and is closable from an open position, each of said oblong binder rings has a major diameter, a minor diameter and a ring perimeter when closed, said interlock closure comprises a tab and a slot, said tab fits substantially flush within said slot so as not to protrude substantially beyond said ring perimeter enabling ring-bound loose-leaves to slide along said ring perimeter unobstructed by said tab and said slot, said spine has a substantially planar portion, said planar portion has said instant user-affixed adhesive attachment, said minor diameter defining an upright ring position when said minor diameter is substantially vertical, said spine perpendicularly attached to each of said oblong binder rings allowing each of said oblong binder rings to stand upright when said planar portion of said spine is horizontal, whereby said instant user-affixed adhesive attachment offers ready, quick and easy mounting of said skeleton upon a user-selected complementary cover such as a file folder, special shape of said oblong binder rings facilitates attachment thereof to said complementary cover that is extra thin to save storage space while preserving nimble page-turning of ring-bound loose-leaves when said complementary cover is open 180 degrees, and flush fitting of said tab and said slot eases ring closure and improves said oblong binder ring appearance each of said oblong binder rings has roughly-vertical column-like stiff portions when situated in said upright ring position;

each of said oblong binder rings has a roughly-horizontal bow-like flexible upper portion when situated in said upright ring position;

each of said oblong binder rings has a roughly-horizontal lower portion when situated in said upright ring position;

each of said oblong binder rings is reversibly compressible relative to a moderate compressive force roughly exerted in the direction of said minor diameter such that said column-like stiff portions resist permanent buckling while said bow-like flexible upper portions more readily flatten and widen outward to provide much of desired reversible vertical compressibility, each of said oblong binder rings springs back to resume a relaxed expanded form upon removal of said moderate compressive force.

18. The binder of claim 17 further comprising:

at least one elastic pivot;

said elastic pivot enabling at least a ring one of said oblong binder rings to rotate relative to said planar portion of said spine.

19. The binder of claim 17 wherein at least one of said oblong binder rings has a protruding paper-catch ring-edge.

20. A loose-leaf binder comprising:

a cover;

a plurality of independently openable elastic binder rings that are each securely closable via a respective interlock closure;

at least one elastic pivot or hinge joint;

each of said interlock closures having a tab and a slot at opposing ends of a curved member that are snapped together flush to form a smooth securely-closed ring, at least a portion of said cover is disposed in a flat formation with a near-ring edge when said cover is open 360 degrees, each of said elastic binder rings aligned and attached to said cover adjacent said near-ring edge, each of said elastic binder rings having an inner diameter greater than a thickness of said flat formation, said elastic pivot or hinge joint located adjacent said near-ring edge and enabling a portion of at least one of said elastic binder rings to rotate about said near-ring edge;

said elastic pivot or hinge joint is disposed flush or flatly relative to said flat formation of said cover to enable a sufficiently smooth surface for writing on ring-bound loose-leaves stacked thereon, and said elastic pivot or hinge joint remaining flush or flat relative to said flat formation when said portion of at least one of said elastic binder rings rotates about said near-ring edge, a portion of each of said elastic binder rings rotatable about said near-ring edge to enable each of said elastic binder rings to straddle the two parallel geometric planes respectively containing the top and bottom surfaces of said flat formation of said cover, said elastic pivot or hinge joint is roughly axially disposed relative to opposing rotations of said flat formation and said elastic binder rings while said elastic binder rings remain closed, whereby ring-bound loose-leaves stacked flatly above said flat formation are substantially parallel to ring-bound loose-leaves stacked flatly below said flat formation when said binder is open 360 degrees and placed on a flat surface.

21. The binder of claim 20 wherein said cover comprises a front cover, middle cover, and back cover, said front cover comprising a semi-rigid board, said back cover comprising a semi-rigid board, said middle cover comprising a flexible foldable material, said middle cover joining said front cover to said back cover.

22. The binder of claim 21 wherein said front cover has loose-leaf holes, said front cover being ring-bound on said elastic binder rings like a loose-leaf.

23. The binder of claim 20 wherein said flat formation of said cover has margin supports separated by ring slots, said ring slots respectively receive said elastic binder rings to enable rotation of said elastic binder rings through the near-ring edge of said flat formation of said cover, whereby said margin supports provide writing support to loose-leaves between the punched ring holes and the adjacent loose-leaf edge.

* * * * *